US006450230B1

(12) United States Patent
Otruba

(10) Patent No.: US 6,450,230 B1
(45) Date of Patent: Sep. 17, 2002

(54) LABELING APPARATUS AND METHODS THEREOF

(75) Inventor: Svatoboj Otruba, Ceres, CA (US)

(73) Assignee: S-Con, Inc., Cincinnati, OH (US)

( * ) Notice: Subject to any disclaimer, the term of this patent is extended or adjusted under 35 U.S.C. 154(b) by 0 days.

(21) Appl. No.: 09/339,743

(22) Filed: Jun. 24, 1999

(51) Int. Cl.[7] ..... B65C 9/00; B65C 9/06; B65C 9/04

(52) U.S. Cl. ..... 156/566; 156/542; 156/567; 156/DIG. 24; 156/DIG. 27

(58) Field of Search ..... 156/540, 541, 156/542, 567, 568, 556, 566, DIG. 25, DIG. 26, DIG. 27, DIG. 28, DIG. 24

(56) References Cited

U.S. PATENT DOCUMENTS

| | | | |
|---|---|---|---|
| 787,744 | A | 4/1905 | Fisher et al. |
| 1,691,027 | A | 11/1928 | Novick |
| 1,696,329 | A | 12/1928 | Saatman |

(List continued on next page.)

FOREIGN PATENT DOCUMENTS

| | | |
|---|---|---|
| DE | 196419 | 6/1967 |
| DE | 1255567 | 11/1967 |
| DE | 1436046 | 10/1968 |

(List continued on next page.)

OTHER PUBLICATIONS

Dow Chemical Company's, Technical Information for Opticite 320 Film.

Dow Chemical Company's, Technical Information for Opticite 350 Film.

Dow Chemcial Company's, Technical Information for Opticite 620 Film.

Pacific Scientific, Product Literature for "Tough SC700 . . . One Tough Servo".

Pacific Scientific, Product Literature for "SC750 Series".

Burr–Brown, Product Literature for TM2500/TM2700 OEM Microterminals (1987).

, Product Literature for E.M.P. Model #2 Solid State Two-Way Preprint Registration Cut–Off Control Systems.

Lauricare™ Teat Dip Concentrate (34–7030–4074–0) Label, (3M, St. Paul, Minnesota).

Coleman® Liter Jug Label (5590C408), (Coleman Outdoor Products, Witchita, Kansas).

Zep® Reach Hand Cleaner Label (1288B), (Zep Mfg. Col. Atlanta, Georgia).

(List continued on next page.)

*Primary Examiner*—Richard Crispino
*Assistant Examiner*—Sue A. Purvis
(74) *Attorney, Agent, or Firm*—Wood, Herron & Evans, L.L.P.

(57) ABSTRACT

A labeling apparatus and method utilize a fluid dispenser in connection with an adhesive applicator to improve the reliability of label feed by a label transport mechanism during the application of adhesive to a label. The fluid dispenser is configured to direct a flow of fluid toward a nip formed between an adhesive roller on the applicator and the label transport mechanism, and from a position upstream from the nip. A labeling apparatus and method also utilize a starwheel including a rotatable hub and an engagement surface defining a pocket configured to engage an article. The engagement surface is resiliently coupled to the rotatable hub to move between first and second positions to vary a rotational position of the pocket relative to the hub. A labeling apparatus and method further utilize a discharge starwheel to transfer articles from the discharge end of an arcuate guide that opposes a label transfer drum. The drum and arcuate guide adhere a label to an article by cooperatively wrapping the label around the article as the article rolls between the drum and arcuate guide.

8 Claims, 14 Drawing Sheets

U.S. PATENT DOCUMENTS

| | | | | | |
|---|---|---|---|---|---|
| 1,922,767 | A | | 8/1933 | Humphner | 40/2 |
| 1,986,039 | A | | 1/1935 | Ackley | 91/50 |
| 2,214,096 | A | | 9/1940 | Weiss | 216/55 |
| 2,347,445 | A | | 4/1944 | Van Hofe | 91/50 |
| 2,585,250 | A | | 2/1952 | Jones et al. | 216/21 |
| 2,609,926 | A | | 9/1952 | Hartig et al. | 209/74 |
| 2,613,168 | A | | 10/1952 | Totten, Jr. | 154/46 |
| 2,773,617 | A | | 12/1956 | Weiss | 216/13 |
| 3,045,643 | A | | 7/1962 | Mattingly et al. | 118/415 |
| 3,091,245 | A | | 5/1963 | Rudszinat et al. | 131/94 |
| 3,140,573 | A | | 7/1964 | Buttolph | 53/51 |
| 3,247,744 | A | | 4/1966 | Huck et al. | 83/107 |
| 3,264,984 | A | | 8/1966 | Smith, Jr. | 101/227 |
| 3,431,830 | A | | 3/1969 | Stovall | 93/61 |
| 3,542,229 | A | | 11/1970 | Waltenhofen et al. | 215/1 |
| 3,557,933 | A | | 1/1971 | Sopher | 198/33 |
| 3,562,050 | A | | 2/1971 | Hake et al. | 156/567 |
| 3,601,587 | A | | 8/1971 | Thiede | 235/92 CC |
| 3,648,911 | A | | 3/1972 | Pekrul | 226/30 |
| 3,657,043 | A | | 4/1972 | Ploetz et al. | 156/196 |
| 3,690,997 | A | | 9/1972 | Bofinger et al. | 156/567 |
| 3,739,968 | A | | 6/1973 | Bodendoefer | 226/30 |
| 3,750,511 | A | | 8/1973 | Toensing | 83/337 |
| 3,765,991 | A | | 10/1973 | Hoffman | 156/521 |
| 3,794,048 | A | | 2/1974 | Mollins et al. | 131/94 |
| 3,834,963 | A | | 9/1974 | Hoffman | 156/215 |
| 3,841,216 | A | | 10/1974 | Huffman | 101/181 |
| 3,864,187 | A | | 2/1975 | Carter | 156/364 |
| 3,905,859 | A | | 9/1975 | Patterson | 156/443 |
| 3,931,902 | A | | 1/1976 | Love, Jr. | 214/390 |
| 3,949,949 | A | | 4/1976 | Thompson | 242/75.43 |
| 3,955,020 | A | | 5/1976 | Cavanagh et al. | 428/35 |
| 3,963,557 | A | | 6/1976 | Patterson | 156/519 |
| 3,972,428 | A | | 8/1976 | Love, Jr. et al. | 214/85 |
| 4,027,426 | A | | 6/1977 | Wallding et al. | 40/310 |
| 4,032,388 | A | | 6/1977 | Dunning | 156/568 |
| 4,045,275 | A | | 8/1977 | Stohlquist et al. | 156/521 |
| 4,104,845 | A | | 8/1978 | Hoffmann | 53/14 |
| 4,108,706 | A | | 8/1978 | Brands et al. | 156/384 |
| 4,108,709 | A | | 8/1978 | Hoffmann | 156/446 |
| 4,108,710 | A | | 8/1978 | Hoffmann | 156/450 |
| 4,108,711 | A | | 8/1978 | Hoffman | 156/497 |
| 4,111,738 | A | * | 9/1978 | Amberg | 156/458 |
| 4,121,961 | A | | 10/1978 | Brunette et al. | 156/249 |
| 4,174,237 | A | | 11/1979 | Hemming, Jr. et al. | 156/64 |
| 4,181,555 | A | | 1/1980 | Hoffmann | 156/265 |
| 4,188,843 | A | | 2/1980 | Dickey | 83/304 |
| 4,216,044 | A | | 8/1980 | Herdzina et al. | 156/215 |
| 4,221,144 | A | | 9/1980 | Diesch et al. | 83/27 |
| 4,240,863 | A | | 12/1980 | Vinton | 156/361 |
| 4,242,167 | A | | 12/1980 | Hoffmann | 156/357 |
| 4,248,655 | A | | 2/1981 | Kerwin | 156/351 |
| 4,253,899 | A | | 3/1981 | Takemoto et al. | 156/277 |
| 4,264,957 | A | | 4/1981 | Pautzke | 364/469 |
| 4,273,816 | A | | 6/1981 | Tollette | 428/35 |
| 4,288,280 | A | | 9/1981 | Morin | 156/510 |
| 4,293,365 | A | | 10/1981 | Geyser et al. | 156/364 |
| 4,295,915 | A | | 10/1981 | Sakaguchi et al. | 156/361 |
| 4,300,966 | A | | 11/1981 | Hoffmann | 156/156 |
| 4,314,869 | A | | 2/1982 | Crankshaw | 156/215 |
| 4,316,566 | A | | 2/1982 | Arleth et al. | 226/2 |
| 4,336,095 | A | | 6/1982 | Hoffmann | 156/361 |
| 4,339,092 | A | | 7/1982 | Benoy et al. | 242/56 R |
| 4,361,260 | A | | 11/1982 | Hanlan | 226/30 |
| 4,395,300 | A | | 7/1983 | Hoffmann | 156/294 |
| 4,404,880 | A | | 9/1983 | DeLuca | 83/42 |
| 4,406,721 | A | | 9/1983 | Hoffmann | 156/86 |
| 4,416,714 | A | | 11/1983 | Hoffmann | 156/86 |
| 4,425,866 | A | | 1/1984 | Hoffmann | 118/58 |
| 4,469,548 | A | | 9/1984 | Jörss | 156/567 |
| 4,500,386 | A | | 2/1985 | Hoffmann | 156/449 |
| 4,519,868 | A | | 5/1985 | Hoffmann | 156/353 |
| 4,526,645 | A | | 7/1985 | Malthouse et al. | 156/350 |
| 4,545,832 | A | | 10/1985 | Hoffmann | 156/86 |
| 4,552,608 | A | | 11/1985 | Hoffmann et al. | 156/351 |
| 4,554,774 | A | | 11/1985 | Miyashita et al. | 53/52 |
| 4,561,928 | A | | 12/1985 | Malthouse | 156/497 |
| 4,566,933 | A | | 1/1986 | Crankshaw et al. | 156/444 |
| 4,567,681 | A | | 2/1986 | Fumei | 40/310 |
| 4,574,020 | A | | 3/1986 | Fosnaught | 156/80 |
| 4,592,796 | A | | 6/1986 | Schlacht | 156/450 |
| 4,604,154 | A | | 8/1986 | Fosnaught | 156/264 |
| 4,629,528 | A | | 12/1986 | Tanaka et al. | 156/351 |
| 4,632,721 | A | | 12/1986 | Hoffmann et al. | 156/458 |
| 4,641,558 | A | | 2/1987 | Hoffmann | 83/152 |
| 4,671,843 | A | | 6/1987 | Olsen | 156/450 |
| 4,685,318 | A | | 8/1987 | Ueda et al. | 72/185 |
| 4,687,535 | A | | 8/1987 | Voltmer | 156/361 |
| 4,704,173 | A | | 11/1987 | Hoffmann | 156/86 |
| 4,724,029 | A | | 2/1988 | Kontz | 156/256 |
| 4,735,668 | A | | 4/1988 | Hoffmann et al. | 156/215 |
| 4,758,300 | A | | 7/1988 | King et al. | 156/357 |
| 4,763,823 | A | | 8/1988 | Eder et al. | 226/109 |
| 4,763,930 | A | | 8/1988 | Matney | 283/81 |
| 4,781,317 | A | | 11/1988 | Ditto | 226/27 |
| 4,835,720 | A | | 5/1989 | Ditto et al. | 364/561 |
| 4,842,660 | A | | 6/1989 | Voltmer et al. | 156/64 |
| 4,844,957 | A | | 7/1989 | Hoffmann | 428/34.7 |
| 4,864,631 | A | | 9/1989 | Jensen | 382/61 |
| 4,872,931 | A | | 10/1989 | Mitchell | 156/86 |
| 4,922,775 | A | | 5/1990 | Winter | 83/333 |
| 4,923,557 | A | | 5/1990 | Dickey | 156/86 |
| 4,931,122 | A | | 6/1990 | Mitchell | 156/215 |
| 4,956,987 | A | | 9/1990 | Hara et al. | 72/185 |
| 4,977,002 | A | | 12/1990 | Hoffman | 428/34.7 |
| 4,978,416 | A | | 12/1990 | Potter et al. | 156/571 |
| 4,982,887 | A | | 1/1991 | Takahashi | 226/24 |
| 4,985,096 | A | | 1/1991 | Bekker-Madsen | 156/64 |
| 4,998,835 | A | | 3/1991 | Negishi et al. | 400/611 |
| 5,017,261 | A | | 5/1991 | Zodrow et al. | 156/568 |
| 5,024,717 | A | | 6/1991 | Winter | 156/354 |
| 5,030,306 | A | | 7/1991 | Lastra | 156/215 |
| 5,030,311 | A | | 7/1991 | Michal et al. | 156/256 |
| 5,037,499 | A | | 8/1991 | Bright et al. | 156/456 |
| 5,045,140 | A | | 9/1991 | Dickey | 156/215 |
| 5,062,917 | A | | 11/1991 | Zodrow | 156/568 |
| 5,082,105 | A | | 1/1992 | Tincati | 198/473.1 |
| 5,082,520 | A | | 1/1992 | West et al. | 156/450 |
| 5,091,040 | A | | 2/1992 | Otruba | 156/566 |
| 5,102,485 | A | | 4/1992 | Keeler et al. | 156/256 |
| 5,116,452 | A | | 5/1992 | Eder | 156/566 |
| 5,129,568 | A | | 7/1992 | Fokos et al. | 226/27 |
| 5,137,596 | A | | 8/1992 | Potter | 156/497 |
| 5,160,570 | A | | 11/1992 | Dickey | 156/448 |
| 5,224,640 | A | | 7/1993 | Fokos et al. | 226/27 |
| 5,227,005 | A | | 7/1993 | Zodrow et al. | 156/566 |
| 5,235,515 | A | | 8/1993 | Ungpiyakul et al. | 364/469 |
| 5,240,529 | A | | 8/1993 | Hoffmann | 156/86 |
| 5,256,239 | A | | 10/1993 | Voltmer et al. | 156/362 |
| 5,269,864 | A | | 12/1993 | Otruba | 156/215 |
| 5,271,783 | A | | 12/1993 | Potter | 156/86 |
| 5,286,317 | A | | 2/1994 | Treat et al. | 156/64 |
| 5,309,695 | A | | 5/1994 | Frabetti et al. | 53/136.1 |
| 5,344,519 | A | | 9/1994 | Galchefski et al. | 156/456 |
| 5,361,960 | A | | 11/1994 | Fokos et al. | 226/2 |
| 5,375,395 | A | | 12/1994 | Gmeiner | 53/493 |
| 5,380,381 | A | | 1/1995 | Otruba | 156/64 |
| 5,399,216 | A | | 3/1995 | Galchefski et al. | 156/215 |
| 5,403,416 | A | | 4/1995 | Bright et al. | 156/86 |
| 5,403,635 | A | | 4/1995 | Hoffman | 428/34.7 |
| 5,405,487 | A | | 4/1995 | Galchefski et al. | 156/566 |

| | | | | | |
|---|---|---|---|---|---|
| 5,413,651 | A | | 5/1995 | Otruba | 156/64 |
| 5,437,759 | A | | 8/1995 | Westbury | 156/566 |
| 5,441,210 | A | | 8/1995 | Hinton | 242/421.1 |
| 5,455,764 | A | | 10/1995 | Meihofer | 364/161 |
| 5,458,729 | A | | 10/1995 | Galchefski et al. | 156/566 |
| 5,464,495 | A | | 11/1995 | Eder | 156/456 |
| 5,470,300 | A | | 11/1995 | Terranova | 493/11 |
| 5,472,552 | A | | 12/1995 | Speranza et al. | 156/351 |
| 5,478,422 | A | | 12/1995 | Bright et al. | 156/64 |
| 5,486,253 | A | | 1/1996 | Otruba | 156/215 |
| 5,491,010 | A | | 2/1996 | Eder | 428/35.7 |
| 5,501,066 | A | | 3/1996 | Errasti Irarte et al. | 53/556 |
| 5,533,608 | A | | 7/1996 | Adams et al. | 198/478.1 |
| 5,538,575 | A | | 7/1996 | Hinton | 156/215 |
| 5,556,492 | A | | 9/1996 | Vonderhorst et al. | 156/64 |
| 5,635,004 | A | | 6/1997 | Pazdernik et al. | 156/227 |
| 5,702,559 | A | | 12/1997 | Bright | 156/450 |
| 5,741,381 | A | | 4/1998 | Dolence et al. | 156/64 |
| 5,753,350 | A | | 5/1998 | Bright | 428/195 |
| 5,772,001 | A | | 6/1998 | Otruba et al. | 198/459.2 |
| 5,779,835 | A | * | 7/1998 | Rello et al. | 156/187 |
| 5,785,803 | A | | 7/1998 | Schiessl | 156/538 |
| 5,821,724 | A | | 10/1998 | Hinton | 318/798 |
| 5,855,710 | A | | 1/1999 | Hinton | 156/86 |
| 5,858,143 | A | | 1/1999 | Bright et al. | 156/86 |
| 5,858,168 | A | | 1/1999 | Hinton | 156/566 |
| 5,863,382 | A | | 1/1999 | Hinton | 156/510 |
| 5,897,722 | A | | 4/1999 | Bright | 156/86 |
| 5,915,612 | A | | 6/1999 | Hinton | 226/30 |
| 5,922,422 | A | | 7/1999 | Otruba | 428/34.1 |
| 5,964,974 | A | | 10/1999 | Hinton | 156/215 |
| 5,964,975 | A | | 10/1999 | Hinton | 156/215 |
| 6,146,496 | A | * | 11/2000 | Phan | |

FOREIGN PATENT DOCUMENTS

| | | | |
|---|---|---|---|
| DE | 2049508 | | 4/1971 |
| DE | 3529716 | A1 | 5/1987 |
| DE | 4314142 | C1 | 7/1994 |
| DE | 19654350 | A1 | 6/1998 |
| EP | 0 009 739 | | 4/1980 |
| EP | 0 011 967 | | 6/1980 |
| EP | 0 074 165 | | 3/1983 |
| EP | 0 441 617 | A1 | 8/1991 |
| EP | 0 630 723 | A2 | 12/1994 |
| EP | 0 787 667 | A1 | 6/1997 |
| GB | 313679 | | 6/1929 |
| GB | 777133 | | 6/1957 |
| GB | 2 096 795 | A | 10/1982 |
| GB | 2 187 163 | A | 3/1987 |
| JP | 58-147635 | | 9/1983 |
| JP | 0075322 | | 3/1989 |
| JP | 40-4173619 | | 6/1992 |
| JP | 6-99961 | | 4/1994 |
| WO | WO 93/21071 | | 10/1993 |
| WO | WO 94/15842 | | 7/1994 |
| WO | WO 95/16612 | | 6/1995 |
| WO | WO 97/10953 | | 3/1997 |
| WO | WO 97/48608 | | 12/1997 |
| WO | WO 98/00339 | | 1/1998 |

OTHER PUBLICATIONS

Original New York Seltzer® Raspberry Flavor Label (ZR–E913–MR10BC 9 5), (New York Selzer Co., Walnut, California).

Clear Cola Crystal Pepsi® (7A–461) Label.

diet Coke Label (1991–2522 2L), (The Coca–Cola Company).

Sunny Delight® Orange Juice Label.

BH2000 Product Literature, B & H Manufacturing, Inc. (1984), 1 page.

BJ2300 Product Literature, B & H Manufacturing, Inc. (1986), 1 page.

BH200 Product Literature, B & H Manufacturing, Inc. (at least 1984), 2 pages.

TRINE Quick Change 4500 Product Literature, *Trine Labeling Systems*, (1997), 4 pages.

Metger, Brian, *TRINE Quick Change 4500*, (product on sale since at least 1997), 1 page.

MR Etikettiertechnik, GmBH & Co. Product Literature, (product on sale since at least 1997), 3 pages.

TRINE 5500 Product Literature, Trine Manufacturing Co., (at least 1984), 10 pages.

NJM Thorobred® 350 Brochure, NJM Inc., (at least 1979), 2 pages.

"New Products, New Plants, New People: NJM Broadens Base with Expanded Line at Lower Prices", *Good Packaging*, NJM, (at least 1979), p. 8.

* cited by examiner

LABELING APPARATUS AND METHODS THEREOF

CROSS-REFERENCE TO RELATED APPLICATIONS

The present application is related to U.S. patent application Ser. No. 09/105,876, filed Jun. 26, 1999 by Otruba et al., entitled "LABELING APPARATUS WITH WEB REGISTRATION, WEB CUTTING AND CARRIER MECHANISMS, AND METHODS THEREOF", the disclosure of which is incorporated by reference herein.

FIELD OF THE INVENTION

The invention is generally related to labeling machinery and adhesive applicators for use therewith, and to the application of adhesive to label material, e.g., for use on articles such as beverage containers and the like. The invention is also related to the feeding of containers through labeling machinery and the like, particularly using starwheel container transport mechanisms.

BACKGROUND OF THE INVENTION

In a great number of consumer product markets, particularly those which are low-margin and/or price-driven, an ongoing need exists for various manners of reducing product costs. For example, just-in-time manufacturing techniques, which reduce costs through minimizing inventory, have grown in prominence. In addition, improved packaging techniques and materials are constantly being developed to minimize the packaging component of product costs.

Just-in-time manufacturing can place significant demands on product manufacturing and packaging equipment due to the quick turnaround that is often required to timely fill customer orders. As a result, there is an ongoing need for a manner of increasing the speed of product manufacturing and packaging equipment so that inventory costs can be reduced without adversely impacting a manufacturer's ability to fill customer orders in a timely fashion.

For example, for bottled beverages such as soft drinks, beer, juice, liquor, etc., significant efforts have been expended in attempting to lower the costs associated with applying product labels to beverage containers such as glass bottles, plastic bottles, aluminum cans, and the like. A particularly cost-effective manner of labeling beverage containers utilizes a continuous web of pre-printed polymer label material that is cut into predetermined lengths, supplied with adhesive, and applied directly to the surface of a container. Adhesive costs may also be reduced by applying adhesive only to the leading and trailing edges of individual labels and wrapping the labels completely around the containers.

High speed operation of continuous-feed labeling machinery, in particular, requires careful control over labels as they are fed from the supply roll, cut from the web, supplied with adhesive and applied to containers. In most continuous-feed labeling machinery, labels are transferred from station to station by a sequence of rollers and drums. A variety of mechanisms, including web tension, mechanical clamps and fingers, and vacuum surfaces, are typically used to assist in the transfer of labels (whether severed or unsevered from a web) from station to station.

Pressurized air is also used in some labeling machinery to improve label control. For example, pressurized air directed toward the leading edge of a label may be used to assist in directing the label from a cutter drum to a transport drum after the label has been severed from a web, or to assist in directing the label from a transport drum to the surface of a container. Also, in some applications pressurized air may be supplied to an unsupported portion of the backside of a seam formed between the leading and trailing edges of a label wrapped around a non-cylindrical article, to strengthen the bond between the leading and trailing edges.

One area of particular concern for many labeling applications is controlling the feed of labels during the application of adhesive. Adhesive applicators used are typically utilized to deposit an adhesive material such as a hot melt or pressure sensitive glue composition to a label immediately prior to placing the label on a container. Typically, such applicators include an adhesive roller that forms a nip with a label transport. mechanism such as a vacuum drum, and that is supplied with a source of adhesive on its outer periphery such that adhesive is applied to a label supported on the transport mechanism as the label is fed past the adhesive roller.

One difficulty associated with conventional adhesive applicators is that the leading edge of a label can in some instances separate from the surface of the transport mechanism and follow the adhesive roller as the leading edge of the label exits the nip formed by the adhesive roller and the underlying transport mechanism. When this occurs, the label will often jam the adhesive applicator and the remainder of the labeling machinery, resulting in defective product and downtime associated with cleaning and restarting the machine.

To address this concern, some adhesive applicators utilize mechanical devices such as a series of parallel wires adjacent an adhesive roller to keep the leading edge of a label from wrapping around the roller. However, in many instances the parallel wires leave undesirable patterns on the adhesive applied to each label. Further, glue droplets on the wires can contaminate both the labels and the transport mechanism. Misadjusted wires can also wrinkle or displace labels on the transport mechanism, resulting in defective labeled articles.

Other labeling machinery designs utilize mechanical hold down devices such as clamps or fingers on a transport mechanism to hold down the leading edge of each label as the label passes an adhesive applicator. Moreover, in some designs in which labels are transported past an adhesive applicator via a vacuum drum, a relatively high level of vacuum is used to resist the adherence of labels to the adhesive applicator. However, mechanical hold down devices and the like are often mechanically complex and can negatively impact performance and reliability. Increased vacuum levels can induce stretching of the label material and necessitate the use of larger and more expensive vacuum pumps.

Another difficulty associated with conventional adhesive applicators is the overspray of adhesive that often occurs during the application of adhesive to the trailing edge of a label. In particular, when a label passes through the nip between an applicator roller and a transport mechanism, the trailing edge (which is supported on the surface of the transport mechanism) may be separated from the roller by a gap across which excess adhesive may spray. A portion of the adhesive may deposit on the surface of the transport mechanism, resulting in contamination of the mechanism. Unless the overspray is periodically cleaned from transport mechanism, the transport mechanism may jam and halt the machine, requiring a more extensive and time consuming cleaning and restart operation. Given that any downtime negatively impacts the efficiency and productivity of labeling machinery, cleaning operations of any type are often highly undesirable.

Therefore, a substantial need exists in the art for an improved manner of feeding labels through labeling machinery, and in particular to improve the reliability of the application of adhesive to labels.

High speed operation of continuous-feed labeling machinery also requires careful control over the containers to which labels are applied. Considerable development efforts, for example, have been expended in improving the handling of containers, whether filled or empty, during a label application operation. Containers are typically fed to and from a labeling machine via a conveyor. Infeed and discharge mechanisms are typically used to transport containers from the conveyor, past a label transport mechanism, and back onto the conveyor.

Significant development efforts have been directed to the infeed mechanism at the head of a labeling machine, incorporating feed screws, starwheels, belts and the like to remove containers from a conveyor and pass the containers past the label transport mechanism with a desired amount of separation. Starwheels, for example, are toothed wheels that carry containers around an arcuate guide within the gaps formed between adjacent teeth, also referred to as pockets. In some implementations, multiple starwheels are used, e.g., where a small flow starwheel introduces initial gaps between incoming containers so that the containers can be picked up by a relatively larger infeed starwheel for transportation past a label transport drum.

One potential problematic characteristic of a starwheel, however, is that in some instances gaps can exist between a container, the starwheel and the guide around which the container is transported. At high speed, the presence of gaps can introduce vibrations and jeopardize the stability of the containers fed through the labeling machine, possibly causing container misfeeds and jamming of the machine.

In addition, at the discharge end of a labeling machine, comparatively less attention has been devoted to the stability of containers transported back onto a conveyor after being labeled. With many labeling machines, for example, labels are rolled onto a container by sandwiching the container between a fixed arcuate guide and a rotating label transport drum. Once a label is applied, one or more moving belts located downstream of the drum contact the containers and attempt to cancel out the spinning of the container before the container is returned to the conveyor. However, at higher speeds, belts may not provide adequate stability, particularly with lightweight containers having relatively high centers of gravity (e.g., unfilled two liter plastic beverage containers). Misfeeds of containers may occur, jamming the machine and requiring a time consuming cleaning and restart operation.

Other labeling machines utilize turrets (which grasp the top and bottom of each container) to transport containers past a label transport drum. In some designs, a discharge starwheel is used to transport containers between a turret and a conveyor. However, discharge starwheels used in such designs simply maintain the same separation of containers between the turret and the conveyor. Whenever containers on a conveyor are separated from one another, the risk of a container falling and creating a "domino" effect in the line is increased.

Therefore, a significant need also continues to exist for an improved manner of reliably transporting containers through labeling machinery, and in particular, to improve the stability of containers transported by infeed and discharge mechanisms of a labeling machine during high speed operations.

SUMMARY OF THE INVENTION

The invention addresses these and other problems associated with the prior art by providing an apparatus and method that provides a number of unique enhancements to facilitate the performance and reliability of a labeling machine, particularly during high speed labeling operations. However, each of these enhancements can be utilized independent of the other enhancements in other applications.

Consistent with one aspect of the invention, a fluid dispenser is used in connection with an adhesive applicator to improve the reliability of label feed by a label transport mechanism during the application of adhesive to a label. The fluid dispenser is configured to direct a flow of fluid toward a nip formed between an adhesive roller on the applicator and the label transport mechanism, and from a position upstream from the nip. Among other advantages that will become more apparent below, doing so reduces the likelihood that the label will undesirably follow the adhesive roller upon the application of adhesive to the label.

Consistent with another aspect of the invention, a starwheel is provided including a rotatable hub and an engagement surface defining a pocket configured to engage an article. The engagement surface is resiliently coupled to the rotatable hub to move between first and second positions to vary a rotational position of the pocket relative to the hub. Among other applications, the starwheel may be used to control the flow of articles to a second, infeed starwheel in a labeling machine in such as manner that the clearance between the articles and the infeed components is minimized, thereby reducing article vibrations and improving stability.

Consistent with yet another aspect of the invention, a discharge starwheel is utilized to transfer articles from the discharge end of an arcuate guide that opposes a label transfer drum. The drum and arcuate guide adhere a label to an article by cooperatively wrapping the label around the article as the article rolls between the drum and arcuate guide. In some applications, careful control of configuration of the pockets on the discharge starwheel can improve the stability of discharged articles through reducing the spin imparted on articles by the label application process and/or decelerating the articles for pickup by a downstream discharge mechanism.

Consistent with still another aspect of the invention, a discharge starwheel may be utilized intermediate a label application station and a conveyor. The discharge starwheel may include a plurality of teeth defined about a perimeter thereof, with each tooth having a profile that decreases the separation between successive articles between the label application station and the conveyor. By reducing the separation between articles, greater stability on a conveyor may be obtained, as adjacent articles tend to support one another downstream of the label application station.

These and other advantages and features, which characterize the invention, are set forth in the claims annexed hereto and forming a further part hereof. However, for a better understanding of the invention, and of the advantages and objectives attained through its use, reference should be made to the drawings, and to the accompanying descriptive matter, in which there is described exemplary embodiments of the invention.

DETAILED DESCRIPTION

Figure 1:
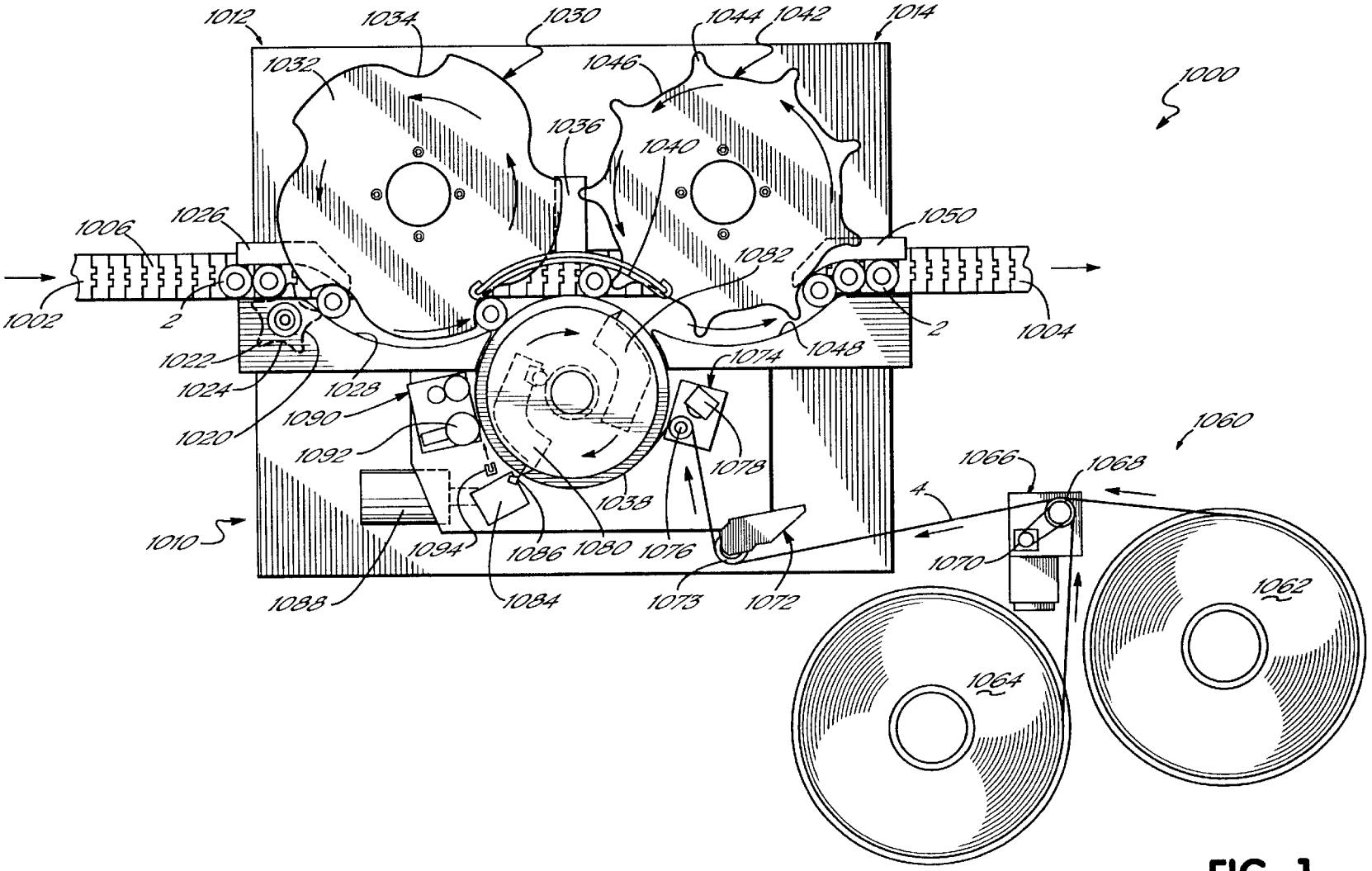
FIG. 1 is a top plan view of a labeling apparatus consistent with the invention.

Turning to the Drawings, wherein like numbers denote like parts throughout the several views, FIG. 1 illustrates a labeling apparatus 1000 consistent with the principles of the invention. With the exception of the specific modifications and enhancements discussed below, apparatus 1000 is similar in configuration and operation to the various designs discussed in U.S. patent application Ser. No. 09/105,876, filed Jun. 26, 1999 by Otruba et al., entitled "LABELING APPARATUS WITH WEB REGISTRATION, WEB CUTTING AND CARRIER MECHANISMS, AND METHODS THEREOF". As such, the reader is directed to this cross-referenced application for a more detailed discussion of such related designs.

Apparatus 1000 is principally used to apply labels in a continuous fashion to a plurality of articles 2 conveyed from an infeed mechanism 1002 to a discharge mechanism 1004 (here, both implemented by a common conveyor 1006). Other infeed and discharge mechanisms, appropriate for the particular articles conveyed to and from labeling apparatus 1000 may be used in other applications, e.g., feed screws, belts, etc. The term "infeed", as used hereinafter, refers to an upstream position or direction relative to the flow of articles and labels. Likewise, the term "discharge" refers to a downstream position or direction relative to the flow of articles and labels.

Apparatus 1000 may be utilized with any number of article designs, including various containers with upright cylindrical portions, e.g., cans or bottles. The articles may be suitable for use in packaging beverages or foodstuffs, or any other type of packaged goods. For example, one suitable application of apparatus 1000 is in applying labels to plastic soft drink bottles, among others.

Articles 2 are conveyed from infeed mechanism 1002 to a label application assembly or mechanism 1010 using an infeed carrier mechanism 1012, and then to discharge mechanism 1004 using a discharge carrier mechanism 1014. Infeed carrier mechanism 1012 includes a flow starwheel 1020 and an infeed starwheel 1030. Flow starwheel 1020 includes a plurality of teeth 1022 that define a plurality of pockets 1024, with each pocket retaining an article 2 for transfer from infeed mechanism 1002 to infeed starwheel 1030 along a path defined between an infeed guide 1026 and an arcuate guide 1028. As will be discussed in greater detail below, flow starwheel 1020 includes a pair of resiliently coupled disks that minimize the clearance between a retained article and the flow and infeed starwheels during transfer of the article between the starwheels.

Infeed starwheel 1030 includes a plurality of teeth 1032 that define a plurality of pockets 1034, each for retaining an article 2 for transfer along arcuate guide 1028 to a label application station 1036 disposed opposite assembly 1010. As will be discussed in greater detail below, flow and infeed starwheels 1020, 1030 increase the separation between successive articles received from infeed mechanism 1002 to a distance suitable for applying labels provided on a label transfer mechanism (here label transfer or applicator drum 1038) in label application assembly 1010. Other label transfer mechanisms suitable for transferring a label to an article for application of the label thereto may be used in the alternative, including both rotary and linear-based transfer mechanisms such as belts, movable pads, magazines for cut labels, etc.

Application station 1036 includes an arcuate guide 1040 against which the articles are compressed by applicator drum 1038 as labels are applied to the articles. Guide 1040 includes a resilient friction surface to impart a rolling action to the articles as the articles pass through the label application station such that labels are wrapped around the articles.

Discharge carrier mechanism 1014, which incorporates a discharge starwheel 1042 having a plurality of teeth 1044 defining a plurality of pockets 1046, performs essentially the same operation as carrier mechanism 1012 except that mechanism 1014 operates to decelerate articles to a linear velocity suitable for transport by discharge mechanism 1004. By doing so, this arrangement imparts greater stability to discharged articles by minimizing relative movement of the articles to the discharge mechanism 1004. Articles are transferred by discharge starwheel 1042 along an arcuate guide 1048 and into a gap formed between guide 1048 and a discharge guide 1050 for discharge onto discharge mechanism 1004.

In the illustrated embodiment, guides 1026, 1028, 1036, 1048 and 1050 are all laterally adjustable (e.g., through set screw arrangements, not shown) to customize the width of the article path to accommodate different diameters of articles. For labeling machines that are used only with one type of article, such adjustments may not be required.

Labels are supplied to applicator drum 1038 from a web supply 1060 supplying a web 4 of labeling material. Typically, web 4 includes a pre-printed polymer material formed of a polymer such as polyethylene. Other materials, including polymers such as polypropylene and polystyrene (among others) may also be used, although polyethylene has the additional advantage in that it is significantly less expensive than other polymers. Polyethylene film tends to be more stretchable than other polymer films. However, due to the constant tension provided in web 4 by the design of label application assembly 1010, the stretchability of this material does not adversely impact the quality of labels supplied by the assembly.

Web supply 1060 includes a pair of supply rolls 1062, 1064, that supply web 4 to a measuring roller assembly 1066. Measuring roller assembly 1066 operates as a linear feed rate sensor using a free-wheeling roller 1068 coupled to a rotational position sensor 1070, e.g., an optical encoder. Web 4 proceeds from assembly 1066 to a web tracking control assembly 1072 (including a roller 1073) that is utilized to maintain lateral alignment of the web in assembly 1010. Web 4 then proceeds to a registration sensor station 1074 that detects the position of registration marks disposed on the web. Station 1074 includes a roller 1076 and a registration sensor 1078 disposed opposite roller 1076 at a lateral position relative to the web to detect registration marks disposed thereon.

From registration station 1074, web 4 proceeds to the surface of applicator drum 1038, where an attraction mechanism (here a plurality of vacuum ports) disposed on the outer surface of the drum applies a controlled tension to the web. Moreover, a pair of movable cutter assemblies 1080, 1082 disposed on drum 1038 operate to sever labels from web 4 as each assembly 1080, 1082 passes a cutting station 1084 having a fixed knife 1086.

As is discussed in greater detail in the cross-referenced parent application, the rate at which web 4 is supplied via web supply 1060 is controlled relative to the rotation of applicator drum 1038 (which is driven by a main drive motor 1088) such that a predetermined length of the web is disposed forward of a cutter assembly 1080, 1082 as the assembly passes fixed knife 1086, whereby individual labels are severed from web 4 in a controlled manner. Moreover, it will be appreciated that the attraction mechanism provided by the drum 1038 is the sole source of tension in web 4 between the drum and each roll 1062, 1064.

In some applications it may be desirable to utilize friction reduction mechanisms in one or more of the rollers 1068, 1073 and 1076 to minimize the amount of force required by the attraction mechanism on drum 1038 to draw web 4 from the supply rolls, particularly during initial startup of the labeling apparatus. For example, in one embodiment, it may be desirable to couple roller 1068 to an air turbine of conventional design, which may be used to in effect compensate for the friction and inertia of the other components feeding web 4 to drum 1038, thus enabling a lower vacuum to be used on drum 1038. In other applications, however, friction reduction in the web supply rolls may not be required.

An adhesive station assembly 1090 is disposed beyond cutting station 1084 to apply adhesive to leading and trailing ends of each label using an application roller 1092, after the label has been severed from the web at cutting station 1084. As will be discussed below, a fluid dispenser 1094 may be used to direct a flow of fluid (e.g., pressurized air) toward the nip formed between roller 1092 and drum 1038, from a position upstream of the nip. Doing so reduces the likelihood of a label following roller 1092 after the application of adhesive thereto. Further, in some applications, the flow of fluid may permit a free portion of the trailing end of a label to wrap around roller 1092 prior to passing the free portion into the nip, which improves the application of adhesive to the trailing end, and often reduces any overspray of adhesive onto the outer surface of drum 1038. Moreover, by reducing the likelihood of the label following roller 1092, often the vacuum level provided to the outer surface of the drum can be reduced, minimizing stretching of the web, and often improving web tracking and cutting as well.

After adhesive is applied to the leading and trailing edges of a label, the label is presented to an article 2 via rotation of applicator drum 1038, whereby rotation of applicator drum 1038 through label application station 1036 wraps the label around the article as the article rolls against guide 1040.

Apparatus 1000 is under the control of a control system (not shown) that coordinates the processing of the web to form labels of suitable size and configuration for application to articles 2, as well as the application of the labels to articles as the articles are passed through the apparatus, essentially in the manner described in the aforementioned cross-referenced application. As such, a detailed discussion of the control system is not provided separately herein.

As discussed above, apparatus 1000 incorporates a fluid dispenser to assist in the application of adhesive to labels, as well as unique flow and discharge starwheel designs to assist in both the infeed and discharge of articles to and from the apparatus. Each of these noted components will be described in greater detail below.

Adhesive Application With Fluid Assist

Figure 2A:
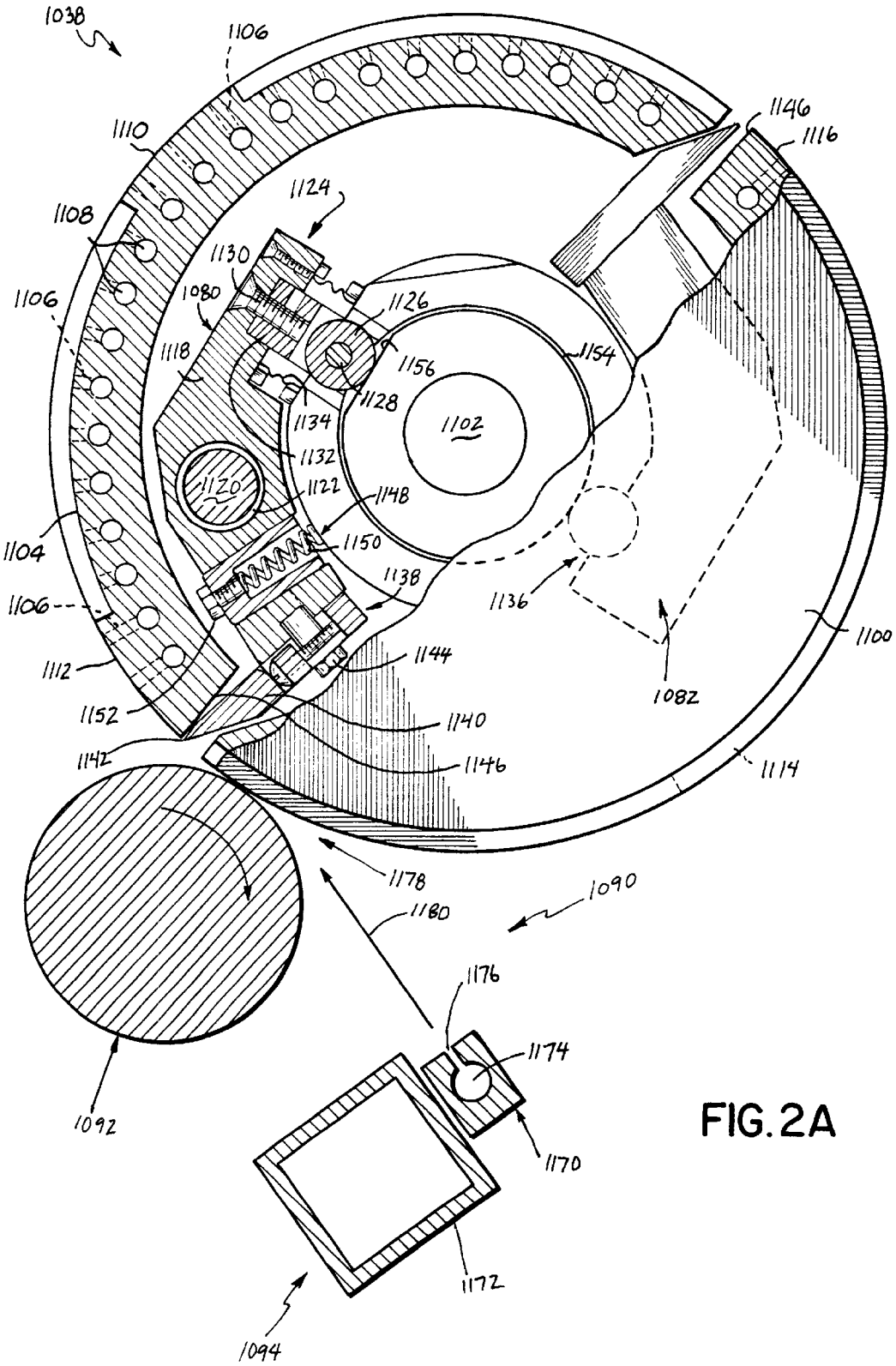
FIG. 2A is a top plan view of the label transfer drum and adhesive applicator of FIG. 1, with portions thereof cut away.

FIG. 2A illustrates applicator drum 1038 and adhesive applicator 1090 in greater detail. Applicator drum 1038 includes a rotatable drum body 1100 configured to rotate about a fixed shaft 1102. Rotatable body 1100 includes an outer surface 1104 having a plurality of vacuum ports 1106 disposed thereon and supplied with a source of negative and/or positive pressure through a set of distribution channels 1108.

Two sets of raised pads 1110, 1112 and 1114, 1116 are disposed on outer surface 1104 to receive leading and trailing edges of a label as the label passes adhesive roller 1092 of applicator 1090 so that adhesive may be applied to the opposing edges of the labels. Applicator roller 1092 is offset from outer surface 1104 such a distance that label material supported on any pad 1110–1116 will be compressed against the roller, but material disposed between the pads will not. Thus, adhesive is applied only to the material supported on a pad.

The leading edges of pads 1110, 1114, and the trailing edges of pads 1112, 1116, are respectively separated from one another around the circumference of drum 1038 at a distance that is approximately the length of the cut labels so that, once a label is severed from the web, the leading and trailing ends thereof are each disposed on a pad when the label passes under adhesive roller 1092. As a result, adhesive is applied only to the leading and trailing ends of each label. In the alternative, roller 1092 may be positioned, and pads 1110–1116 may be separated from one another, to apply adhesive to the leading edge of each label prior to the label being severed from the web (as discussed, for example, in the aforementioned cross-referenced application). Doing so may permit the tension within the web to further assist in maintaining the leading edge of the label on the outer surface of applicator drum 1038 as adhesive is applied to the label.

Figure 2B:
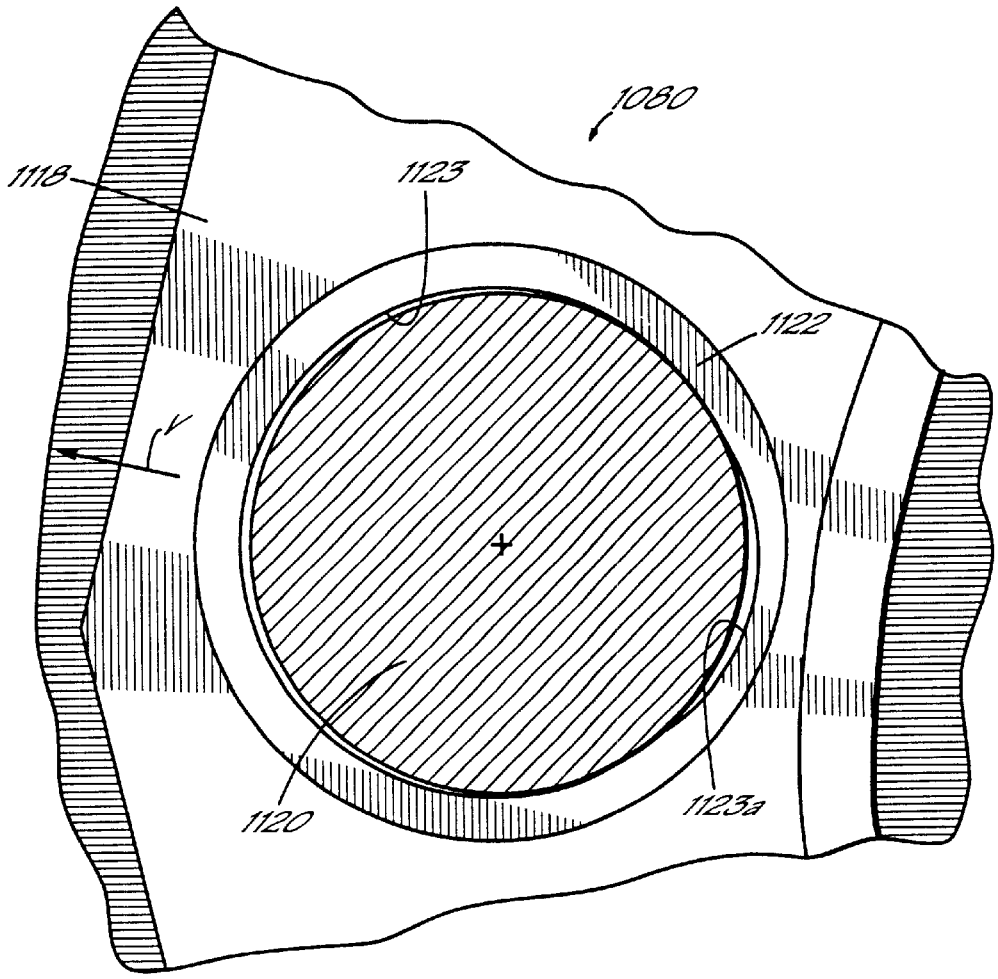
FIG. 2B is an enlarged fragmentary top plan view of a cutter assembly bushing in the label transfer drum of FIG. 2A.

Two sets of pads, pads 1110 and 1112, and pads 1114 and 1116, are provided around the circumference of rotatable body 102, each matched with a cutter mechanism 1080, 1082. Cutter mechanism 1080 (which is configured in a similar manner to cutter mechanism 1082) includes a rocker body 1118 pivotally mounted to pivot about a shaft 1120 that extends parallel to shaft 1102. A bushing 1122 formed of carbon bronze matrix operates as a bearing surface against which shaft 1120 rotates. As shown in FIG. 2B, bushing 1122 includes a bearing surface 1123 with a recessed portion 1123*a* formed directly opposite the force vector (identified at "V") applied to rocker body 1118. The recess is adapted to bear shaft 1120 at two points to minimize lateral movement of the rocker body on the shaft, and thereby stabilize the rocker assembly. Through this configuration, greater cutting precision may be obtained than conventional bushing designs.

Returning to FIG. 2A, at one end of body 1118 is disposed a cam follower assembly 1124 including a roller 1126 rotatably mounted about an axle 1128. Axle 1128 is secured via a bolt 1130 to a follower body 1132, and a flexible boot 1134 seals the assembly. Cam follower assembly 1136 of cutter mechanism 1082 is configured similarly to assembly 1124.

Knife assembly 1138 is disposed at the opposite end of rocker body 1118 from cam follower assembly 1124. A knife blade 1140, having an edge 1142, is secured to the end of rocker body 1118 via a bolt or other securing mechanism 1144. Edge 1142 of knife blade 1140 projects through an opening 1146 in outer surface 1104 of body 1100, immediately following trailing pad 1112 around the circumference of body 1100.

A spring assembly 1148 including a spring 1150 extends perpendicular to shaft 1102 and biases cutter assembly 1080 toward an extended position, with knife blade 1140 projecting through opening 1146 beyond outer surface 1104. A set screw 1152 controls the tension of spring 1150.

Roller 1126 of cam follower assembly 1124 rides along a cam 1154 disposed on the outer surface of shaft 1102. Cam 1154 is circular in cross section with the exception of a recessed portion 1156. Recessed portion 1156 may have any number of profiles, e.g., a flattened profile as illustrated in FIG. 2A. Recessed portion 1156 is angularly oriented such that roller 1126 engages the portion when knife blade 1140 of knife assembly 1138 is directly opposite fixed knife 1086 of cutting station 1084, thereby extending the knife blade at this position to shear a label from the web.

To further assist in maintaining each label on the outer surface of drum 1038 during adhesive application, a fluid dispenser 1094 is disposed in a position to direct a flow of fluid toward the nip formed between adhesive roller 1092 and drum 1038. Fluid dispenser 1094 in the illustrated embodiment includes an air bar 1170 mounted to a fixed post 1172. Air bar 1170 includes a vertical distribution channel 1174 coupled to a source of pressurized fluid (e.g., compressed air or other gas), and a plurality of nozzles 1176 adapted to direct the pressurized fluid (represented at 1180) toward nip 1178. In the illustrated embodiment, air bar 1170 is separated from nip 1178 by approximately four inches, has 10 nozzles, each with 0.04 inch diameters, and is supplied with approximately 20 to 40 psi of pressurized air. Other separations, flow rates, directions of flow (e.g., angle of attack relative to the nip), and other fluid flow parameters may be utilized in other applications.

In operation, the label material is advanced by the web supply at a rate slower than the rotational rate of drum 1038, with the vacuum ports on the drum providing tension to withdraw the web from the web supply. Once an amount of web material suitable to provide a desired length of label is withdrawn from the web supply, the leading edge of the web is supported on a leading pad 1110, 1114. At the same time, cutter mechanism 1080, 1082 passes fixed knife 1086, severing a label from the web. Upon further rotation of the drum, leading pad 1110, 1114 passes adhesive roller 1092 to apply a layer of adhesive to the leading end of the label. Continued rotation of the drum then results in the trailing pad passing the adhesive roller to apply adhesive to the label proximate the trailing edge. Cutting and adhesive application of the label is then complete, and further rotation of the drum (coordinated with the advancement of articles) results in the label being wrapped around an article at station 1036 (FIG. 1).

Figure 3B:
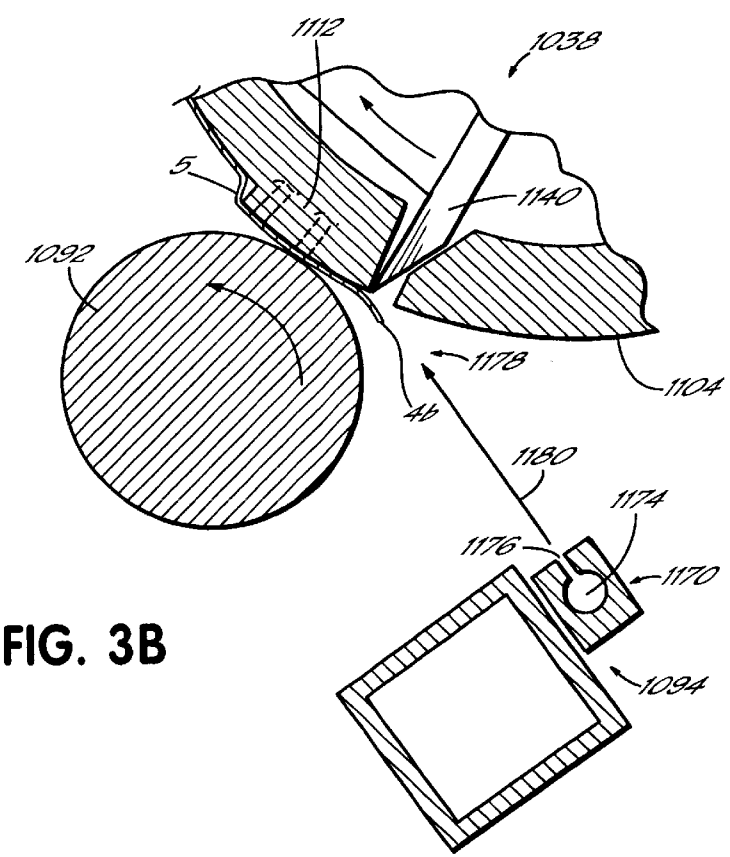
FIGS. 3A and 3B are functional top plan views of the label transfer drum and adhesive applicator of FIG. 2A, respectively illustrating the application of adhesive to leading and trailing ends of a label.
Figure 3A:
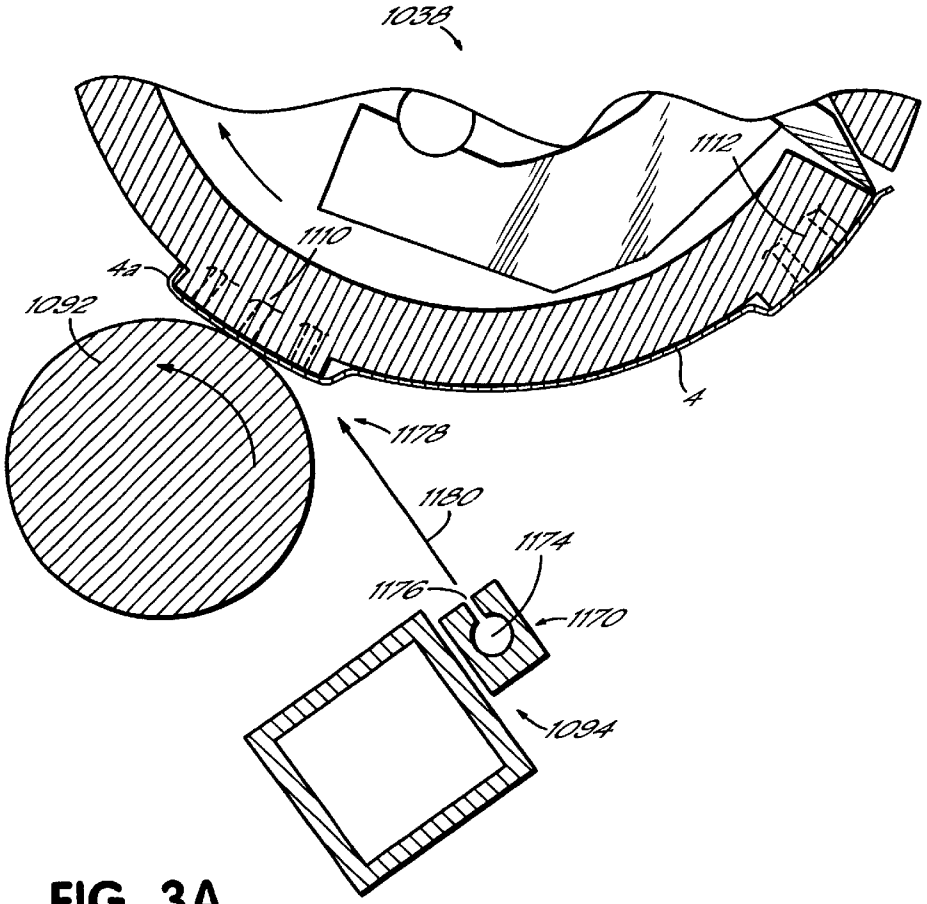

FIGS. 3A and 3B generally illustrate the operation of fluid dispenser 1094 in assisting in the application of adhesive to a label in a manner consistent with the invention. First, as shown in FIG. 3A, when application roller 1092 is applying adhesive to a leading edge 4*a* of a cut label 5, the flow of fluid 1180 directed at nip 1178 assists in preventing leading edge 4a from following adhesive roller 1092 after exiting the nip. As a result, greater reliability is often obtained due to a reduced likelihood of jamming the apparatus as a result of a label misfeed during adhesive application. In addition, in some applications it may be possible to lower the vacuum supplied to drum 1038 while maintaining sufficient reliability, which may be advantageous due to better web tracking, reduced stretching of the web and better cutting performance.

In addition, as shown in FIG. 3B, when application roller 1092 is applying adhesive to a trailing edge 4*b* of label 5, the flow of fluid 1180 directed at nip 1178 may be used to assist in urging the trailing edge 4*b* to lift from trailing pad 1112 and wrap around roller 1092 before entering the nip. In particular, due to the separation between trailing pad 1112 and knife 1140, a portion of label 5 at trailing edge 4*b* is not supported on pad 1112, and thus is left free.

By directing the free end around the roller, adhesive is applied to the very end of the label, which would not otherwise occur since the free end would not be supported on pad 1112. Improved adhesive patterns result, improving the appearance and quality of a labeled article. Moreover, in some applications, directing the free trailing end of the label around the roller reduces the undesirable overspray of adhesive from roller 1092 onto drum 1038, reducing the frequency at which the drum must be cleaned and improving reliability due to reduced likelihood of oversprayed adhesive causing a label misfeed on the drum. Furthermore, in some applications, it may be desirable to increase the amount of free label material at the trailing end of a label to improve the adhesive pattern at the trailing end, e.g., by increasing the separation of a trailing pad from a knife and/or by eliminating one or more rows of vacuum ports from the trailing edge of a trailing pad.

Other fluid dispenser designs may be utilized in the alternative. For example, other configurations of nozzles and other types of fluid ports may be used. Moreover, other fluid sources, e.g., fan motors, airflow that is generated by the shape or other configuration of the drum, etc., may also be used. Other modifications will be apparent to one of ordinary skill in the art.

Article Infeed

Figure 4:
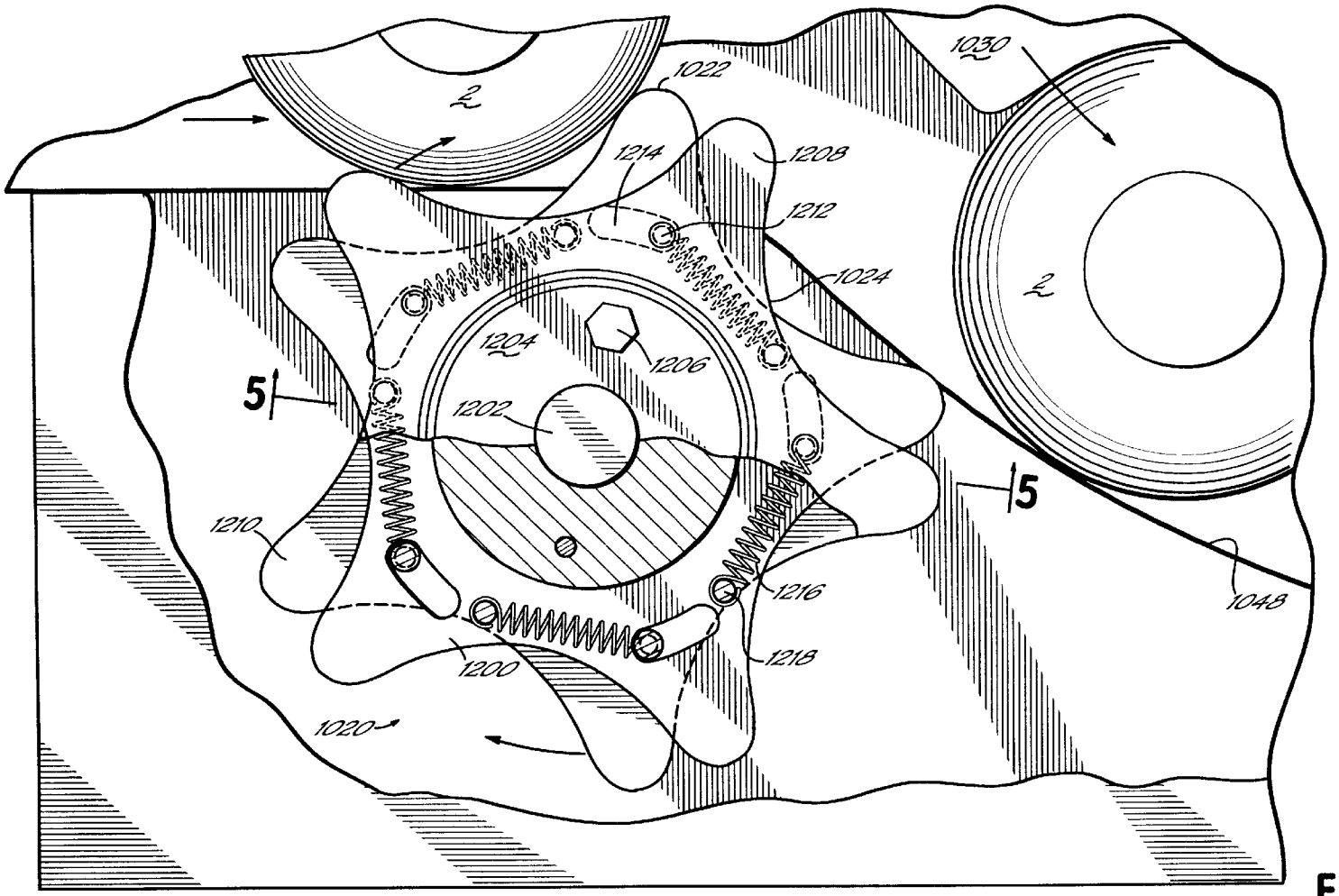
FIG. 4 is a top plan view of the flow starwheel of FIG. 1, with resilient.
Figure 5:
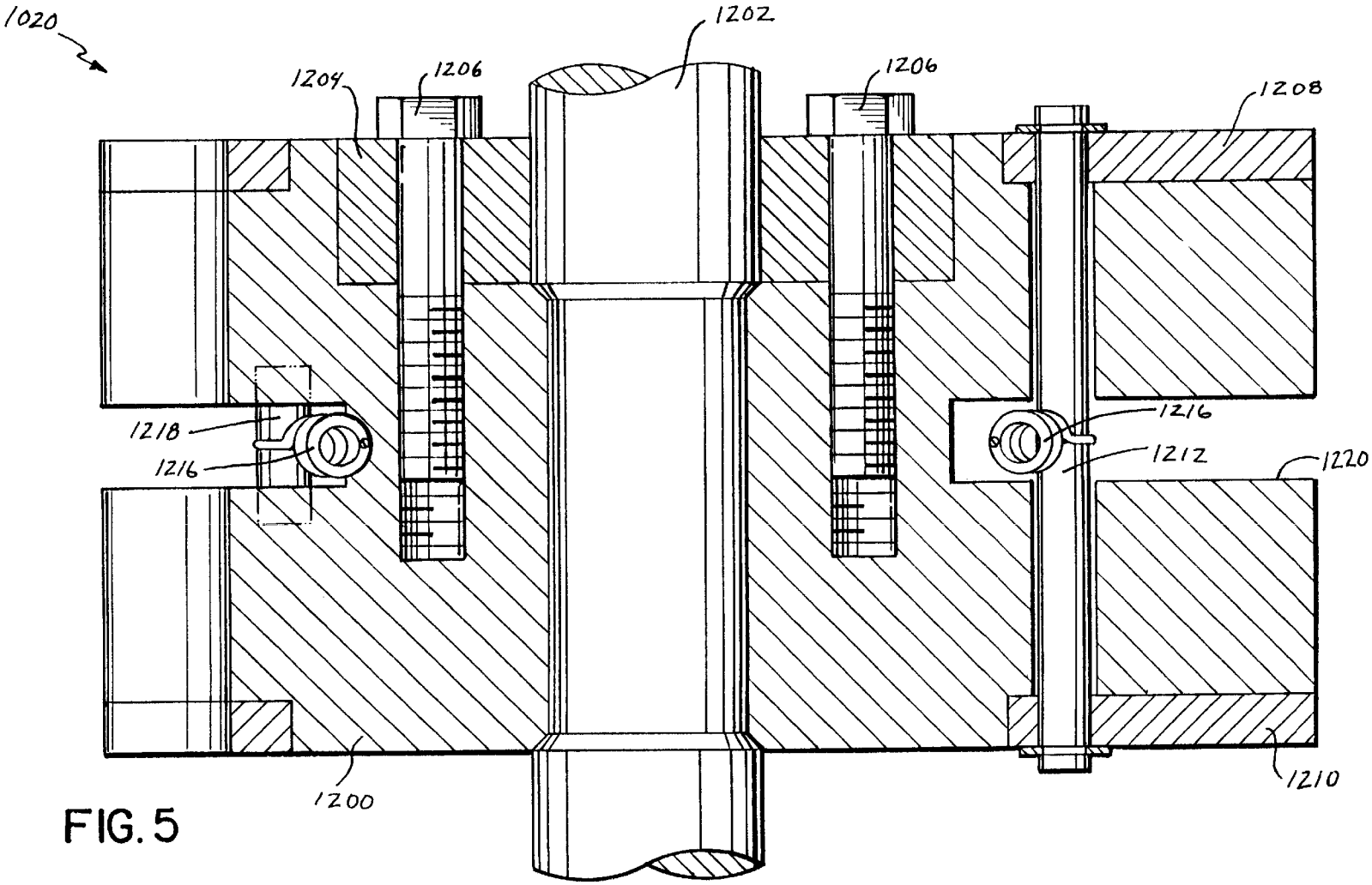
FIG. 5 is a cross-sectional view of the flow starwheel of FIG. 4, taken through lines 5—5.

Returning to FIG. 1, articles 2 are supplied to apparatus 1000 via an infeed mechanism 1002. The flow of these articles into the apparatus is controlled by a flow starwheel 1020, illustrated in greater detail in FIGS. 4 and 5, including a plurality of teeth 1022 forming a plurality of pockets 1024 for advancing articles into the apparatus.

Starwheel 1020 includes a rotatable hub 1200 mounted on a shaft 1202 and secured thereto in a keyed arrangement via a keyed member 1204 secured to the hub by fasteners 1206.

Shaft 1202 is coupled to a drive mechanism (not shown) used to drive the starwheel in a coordinated fashion with starwheels 1030 and 1042, as well as drum 1038, typically through a drive train providing a fixed relative rotation rate for each such component. For example, shaft 1202 may be coupled to a rotatable pulley through a universal linkage, with the pulley coupled via a belt to the other rotatable components in apparatus 1000. It may be desirable to provide a clutch mechanism in the drive for starwheel 1020 to permit the apparatus to be halted in a predetermined rotational position. Other drive mechanisms may also be used in the alternative.

Starwheel 1020 includes a unique engagement surface that is resiliently coupled to the rotatable hub to vary a rotational position of a pocket relative to the hub. By resiliently coupling the engagement surface to the hub, clearance between an article and either of starwheel 1020 and infeed starwheel 1030 (FIG. 1) can be minimized to reduce vibrations in the flow of articles and thereby improve the stability of the articles as they enter apparatus 1000.

Provision of a resiliently-biased engagement surface is made through a pair of disks 1208, 1210 rotatably mounted on opposing surfaces of hub 1200. Each of disks 1208 and 1210 and hub 1022 include cooperative profiles including a plurality of teeth defining a plurality of pockets therebetween. As used herein, therefore, an engagement surface is defined on each pocket of each disk 1208, 1210. Disks 1208 and 1210 are secured to one another by a plurality of shafts 1212 (e.g., five such shafts) retained within cooperating slots 1214 in hub 1200. One end of each slot 1214 defines a position of the cooperating shaft 1212 (and accordingly the disks 1208 and 1210) in which each tooth defined in the profile of each disk aligns with one of the teeth formed in the profile of hub 1200. When each shaft 1212 is disposed at the opposite end of each slot 1214, the teeth defined in the profiles of disks 1208, 1210 are disposed forward of the teeth defined on hub 1200 in the direction of rotation of starwheel 1020. Disks 1208, 1210 are biased in the forward position through the use of a sequence of springs 1216, each secured at one end to shaft 1212 and at the other end to an anchor 1218 disposed within an annular slot 1220 in hub 1200.

It should be appreciated that other resilient members, e.g., coiled or leaf springs, torsion springs, etc., may be utilized to resiliently bias the disks relative to the hub. Furthermore, it should be appreciated that only one disk may be utilized, and in addition it is not necessary in some applications for hub 1200 to have a cooperating profile with each disk 1208, 1210. For example, in other applications it may be desirable to simply utilize a pair of concentric hubs joined through an annular bearing and rotationally resilient coupling mechanism, with the inner hub mounted to the shaft and the outer hub providing the desired starwheel profile.

Figure 9:
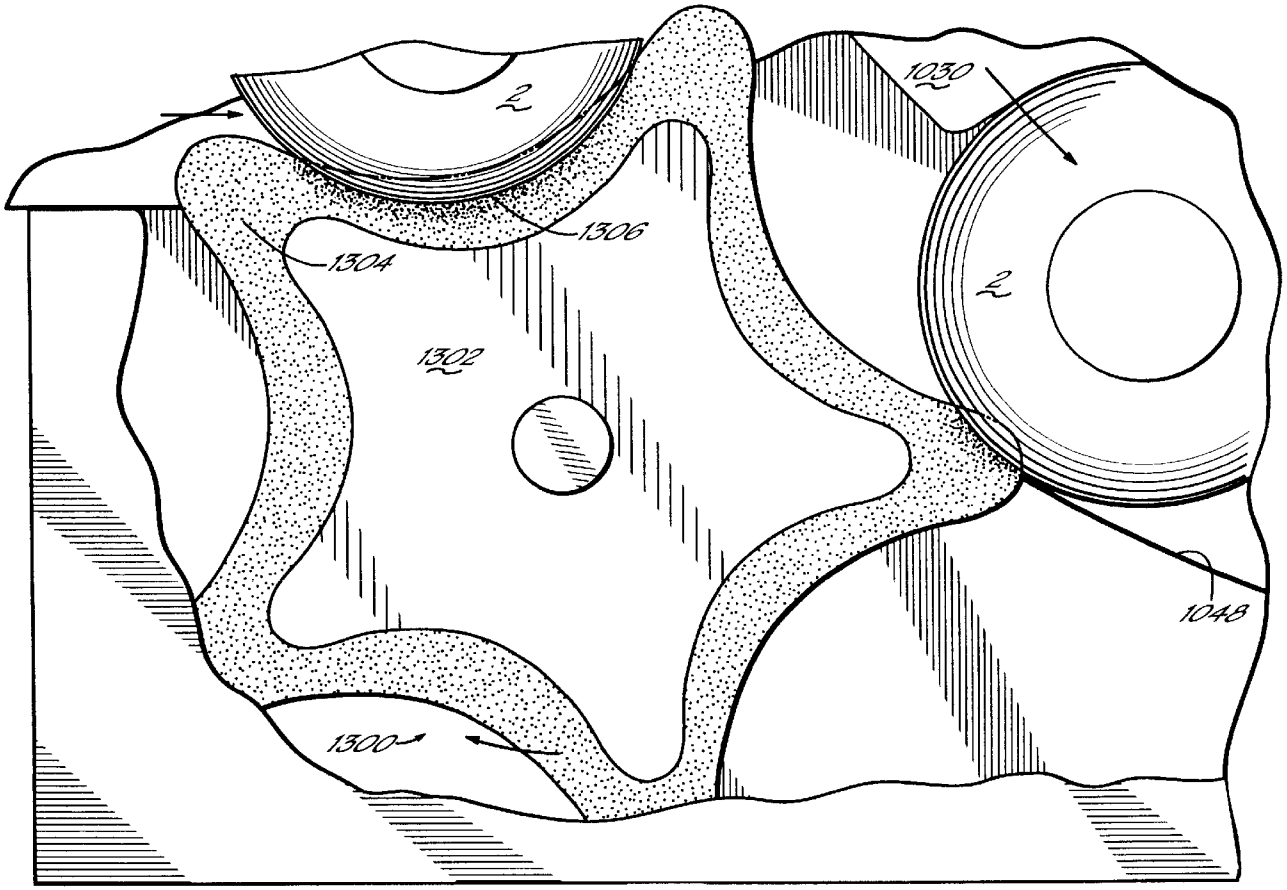
FIG. 9 is a top plan view of an alternate flow starwheel to that of FIGS. 4 and 5, implementing a resilient outer surface.

Other manners of providing a resiliently-biased engagement surface may also be utilized in the alternative. For example, rather than utilizing separate bodies for a hub and an engagement surface, an engagement surface may be resiliently coupled to a hub using a deformable body. As shown in FIG. 9, for example, a starwheel 1300 may include a hub 1302 having a deformable body 1304 (e.g., formed of a resilient material such as rubber) mounted about the periphery thereof to form an engagement surface 1306. Compression forces applied between the resilient body and infeed starwheel 1030 deform the resilient body to compress an article between such components.

Figure 10:
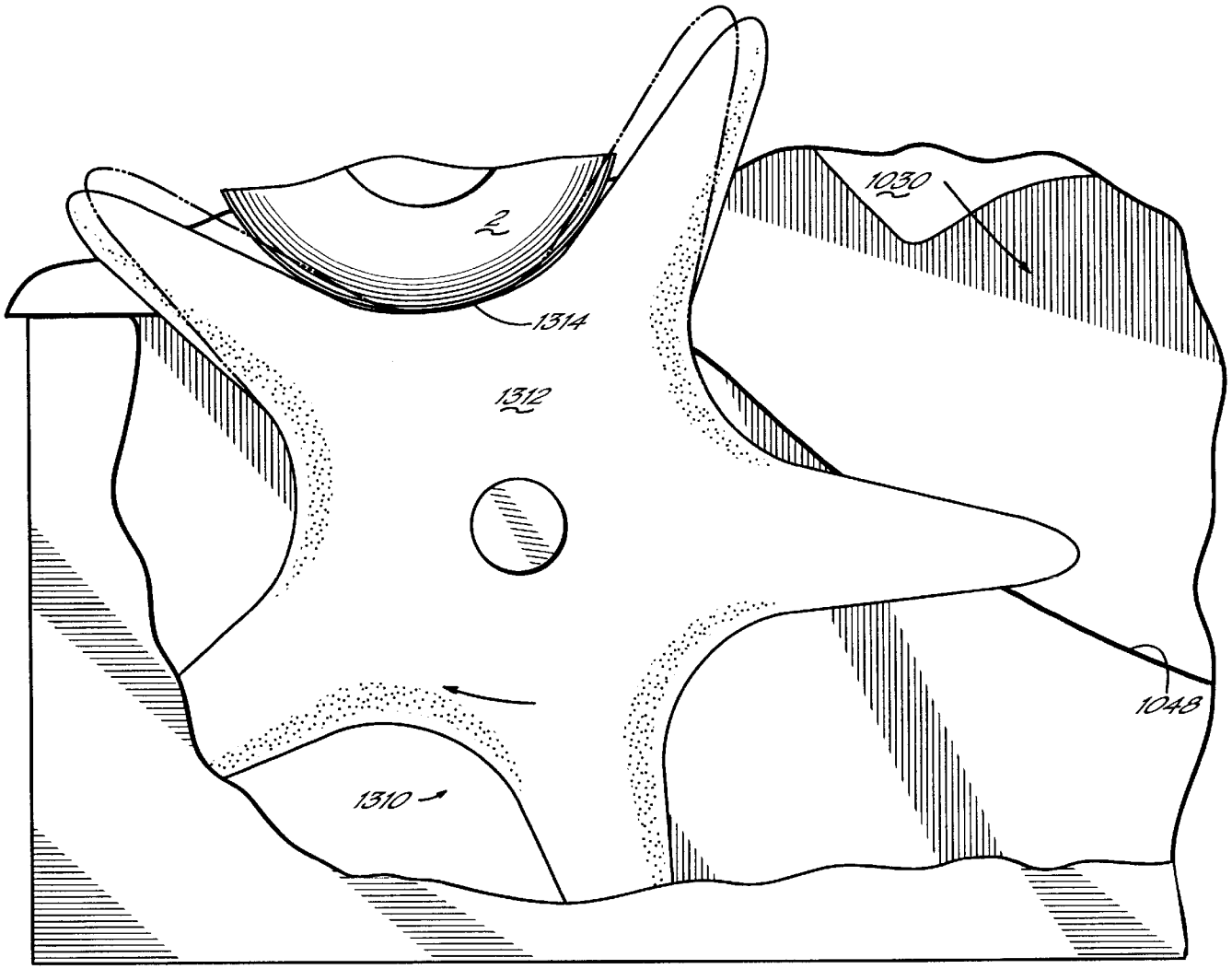
FIG. 10 is a top plan view of another alternate flow starwheel to that of FIGS. 4 and 5, implementing an inflatable body.

Also, other forms of resiliently deformable members, e.g., inflated starwheel spokes and the like, may also be used to provide a resilient coupling between an engagement surface and a hub. For example, as shown in FIG. 10, a starwheel 1310 may include an integrally-formed inflatable body 1312 defining an engagement surface 1314 that is integrally coupled to a hub.

In general, it will be appreciated that a wide variety of resilient engagements, which essentially have the effect of retarding or advancing the rotational position of an engagement surface relative to a rotatable hub (even when such engagements move the engagement surface in a non-arcuate manner), may be used in the alternative.

Figure 6B:
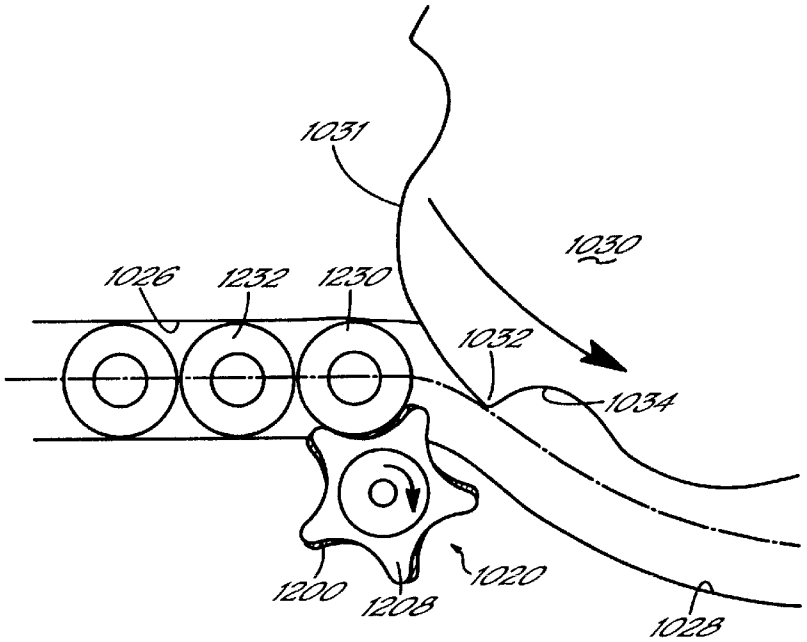
FIGS. 6A–6F are functional top plan views of the article infeed portion of the labeling apparatus of FIG. 1, illustrating the transfer of articles from the conveyor to the infeed starwheel by the flow starwheel.
Figure 6A:
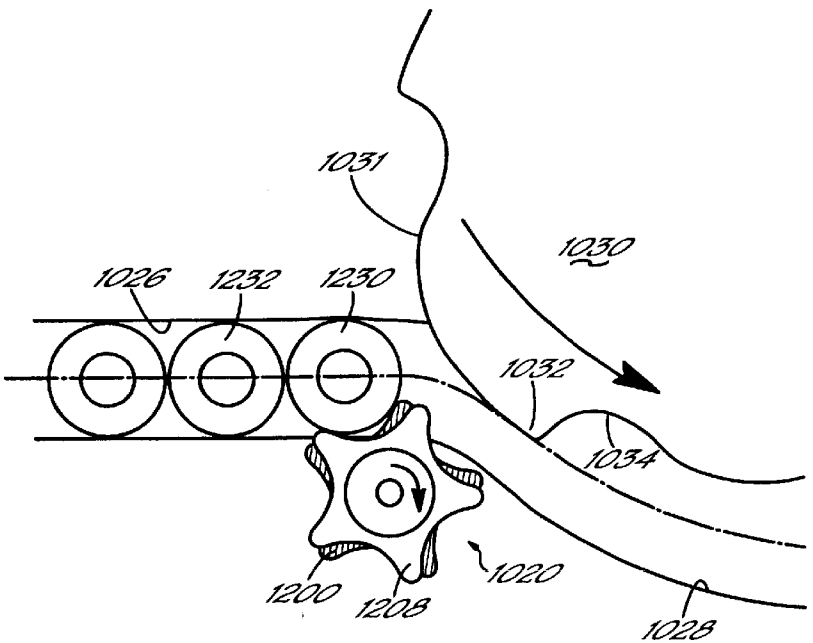
Figure 6D:
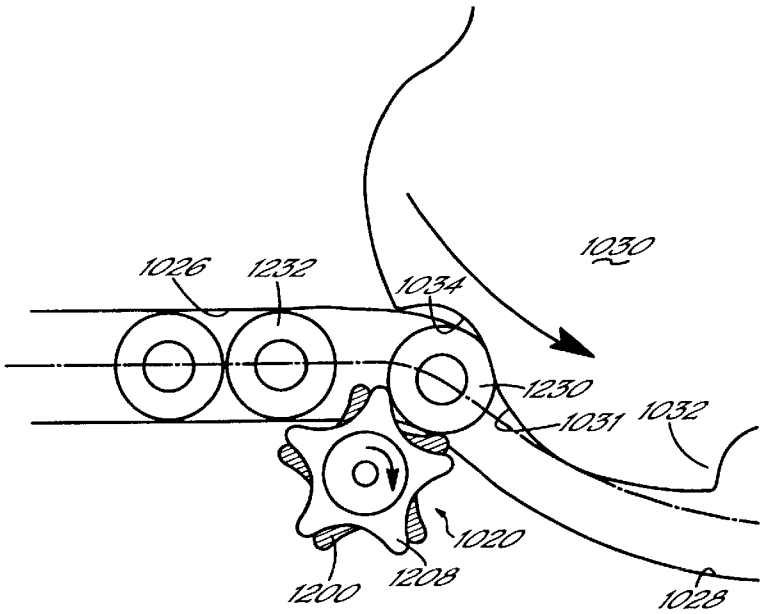
Figure 6C:
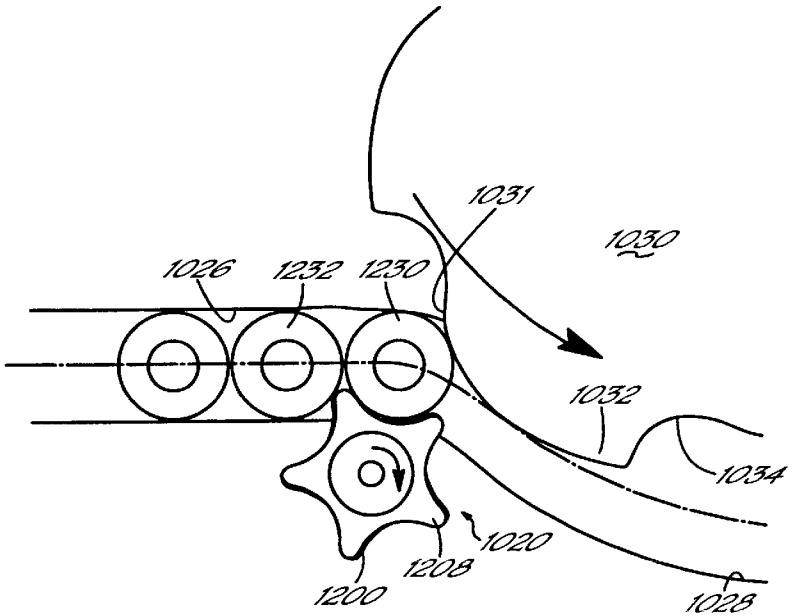

The operation of flow starwheel 1020 in providing articles to infeed starwheel 1030 is illustrated in greater detail in FIGS. 6A–6F. Shown in FIG. 6A are a pair of articles 1230, 1232 supplied to the path defined between guides 1026 and 1028 by an infeed mechanism. Article 1230 is illustrated as being picked up by starwheel 1020, with the article initially disposed on the trailing surface of a tooth on hub 1200. Absent any opposing force on starwheel 1020, disk 1208 (and disk 1210, although such disk is not shown in FIGS. 6A–6F) is biased to a forward position. As shown in FIG. 6B, further rotation of starwheels 1020, 1030 results in the leading edge of a tooth on disk 1208 engaging article 1230, driving the article forward but at the same time overcoming the resilient bias of the starwheel and rotating disk 1208 toward a position in alignment with hub 1200. Next, as shown in FIG. 6C, further rotation of starwheels 1020, 1030 brings article 1230 into contact with the outer surface 1031 of infeed starwheel 1030, and with the disk 1208 in a rearmost rotational position in alignment with hub 1200. Next, as shown in FIG. 6D, further rotation of starwheels 1020 and 1030 begins to draw article 1230 into pocket 1034 defined on outer surface 1031 of infeed starwheel 1030. However, as the article recesses into the pocket, the resilient bias of disk 1208 rotates the disk forward to maintain contact between article 1230 and disk 1208 as the transfer of the article from flow starwheel 1020 to infeed starwheel 1030 occurs. As a result, any gaps between the article and the respective outer surfaces of starwheels 1020 and 1030 are minimized.

Figure 6F:
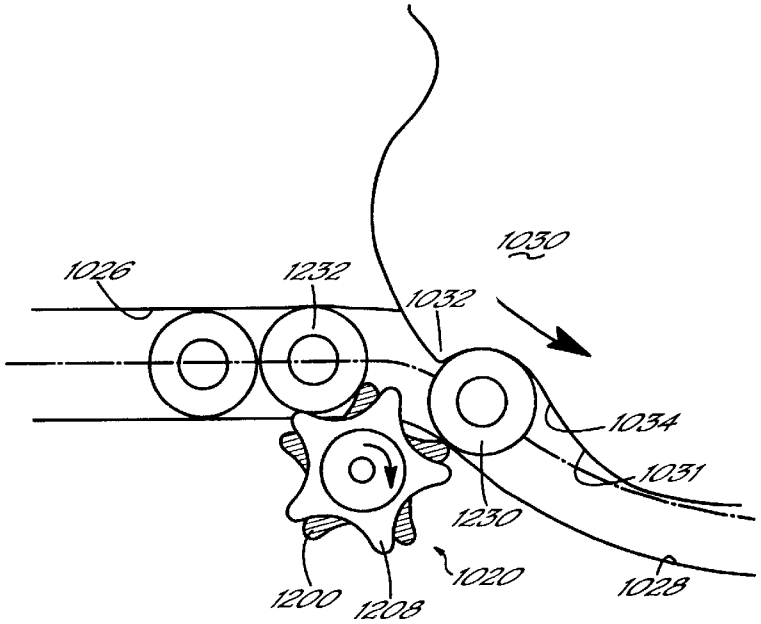
Figure 6E:
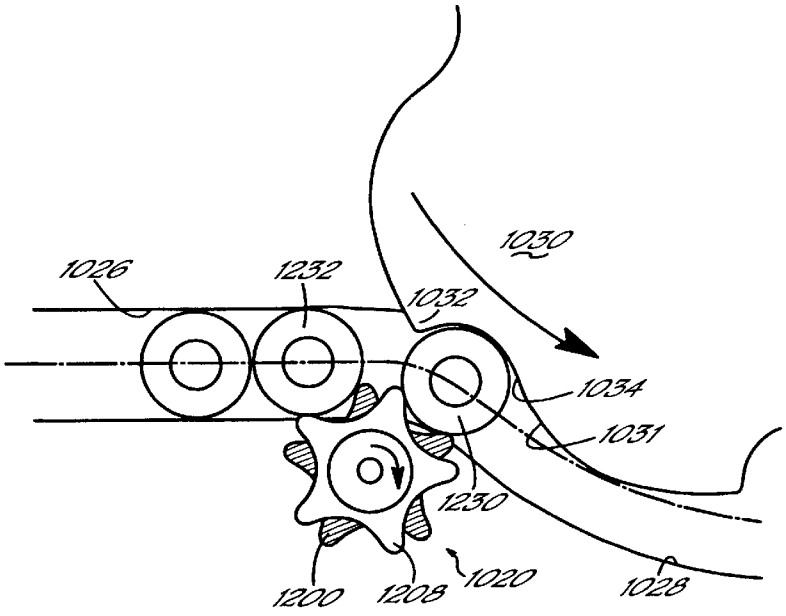

Upon further rotation (FIG. 6E), article 1230 becomes seated in pocket 1034, with disk 1208 of starwheel 1020 positioned at its forward-most position relative to hub 1200. In addition, the next article in sequence, article 1232, is shown engaging the next pocket of starwheel 1020. Article 1230, however, is still compressed to an extent between disk 1208 and starwheel 1030. FIG. 6F next illustrates the release of article 1230 from starwheel 1020, with the article securely retained within in pocket 1034 of starwheel 1030. Article 1232 is then in position for transfer to the next pocket in sequence for starwheel 1030.

Through maintaining compression of an article between starwheels 1020 and 1030, vibrations in the articles are minimized, and as a result, the stability of the articles feeding into the apparatus is improved. It should be appreciated that the use of a resiliently-biased engagement surface as described herein may be utilized on other starwheels consistent with the invention, e.g., in any application in which it is desirable to transfer an article from a starwheel to another transfer mechanism such as another starwheel or the like. Other modifications will also be apparent to one of ordinary skill in the art.

Article Discharge

Returning to FIG. 1, once an article is collected by infeed starwheel 1030, the article is transported along guide 1028 to a gap disposed between an arcuate guide 1040 and the outer surface of drum 1038, whereby the article is rolled about a rolling axis (typically the longitudinal axis of an article taken through the center point of the circular cross-section of the article) and a label is wrapped around the article. Once at least a portion of a label is wrapped around an article, the article is fed from the gap between drum 1038 and guide 1040 by a discharge carrier mechanism 1014 including a discharge starwheel 1042 with a plurality of teeth 1044 defining a plurality of pockets 1046 therebetween.

FIGS. 7A–7D illustrate the configuration and operation of discharge starwheel 1042 in greater detail, with a plurality of articles 1240, 1242, 1244 and 1246 illustrated at various points along the guide 1048.

Each pocket 1046 of discharge starwheel 1042 is defined by a series of arcs between adjacent teeth 1044. In the illustrated embodiment, the width of each pocket (defined by the separation between adjacent teeth) is greater than the diameter of each article such that the precision required to engage an article within a pocket is reduced. Furthermore, in the illustrated embodiment, each pocket is defined by first, second and third sections 1250, 1254 and 1252, with the first and second sections 1250, 1252 defined by leading and trailing edges of adjacent teeth, and having a radius of curvature that is less than that of the intermediate third section 1254. Section 1254, providing an engagement surface initially contacting an article, is provided with a relatively larger radius of curvature to minimize the coefficient of friction between the pocket and the article during initial contact with the article. Section 1250, however, has a lower radius of curvature to provide a relatively higher coefficient of friction with the article once the article is engaged with section 1250. Providing a higher coefficient of friction assists in canceling the spin induced on the article by the label application process. The transition from section 1254 to section 1250 is gradual, however, so that the coefficient of friction increases as the article slides back in pocket 1046, and a gradual deceleration of the rotational velocity of the article is obtained.

Figure 7B:
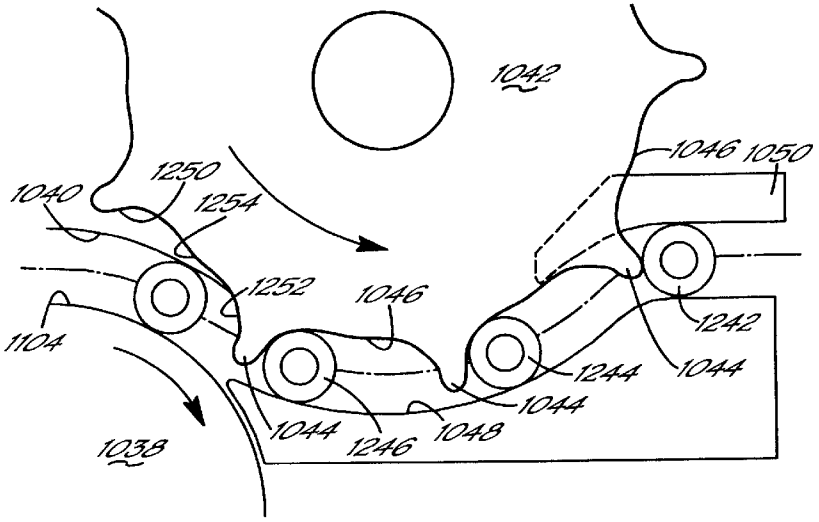
FIGS. 7A–7D are functional top plan views of the article discharge portion of the labeling apparatus of FIG. 1, illustrating the transfer of articles from the drum to the conveyor by the discharge starwheel.
Figure 7A:
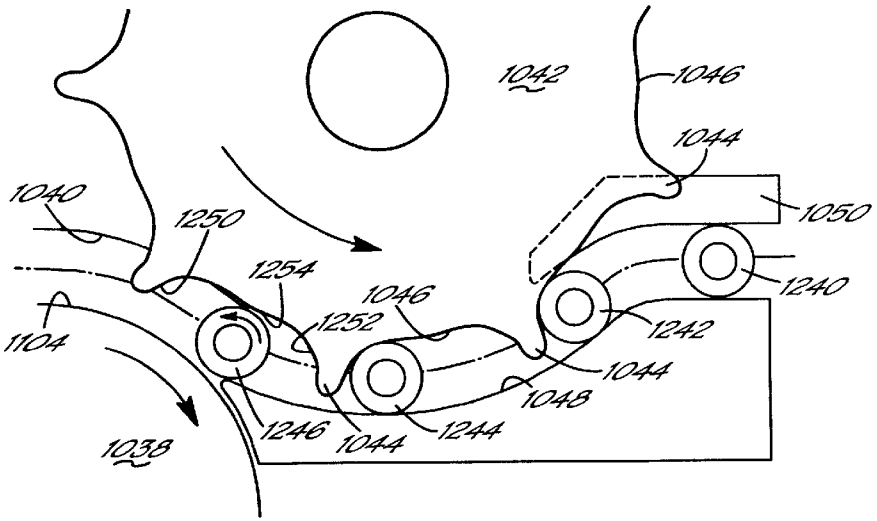

As shown, for example in FIG. 7A, article 1246 initially contacts a pocket of starwheel 1042 between adjacent teeth 1044. Then, as shown in FIG. 7B, the article 1246 is allowed to slide back into engagement with the trailing tooth 1044, with the rotation thereof canceled via the coefficient of friction with the section 1250 of the pocket.

Returning again to FIG. 7A, the configuration of starwheel 1042 is also specifically designed to stabilize the discharge of articles from guide 1048 onto the discharge mechanism (here conveyor 1004 of FIG. 1). Each tooth 1044 of starwheel 1042 is configured to impart a decreasing linear velocity to each article as it is discharged along guide 1050 to the conveyor. The rotation rate of starwheel 1042 is selected to provide a tangential velocity of articles transferred by starwheel 1042 that is initially greater than the linear velocity of the conveyor. However, by conveying the articles along a linear portion of guide 1050, and by providing a decreasing linear velocity through engagement with each tooth 1044, the linear velocity of the articles is decelerated below that of the conveyor, thereby permitting the conveyor to transport the articles away from the starwheel once the linear velocity thereof falls below that of the conveyor.

Figure 7D:
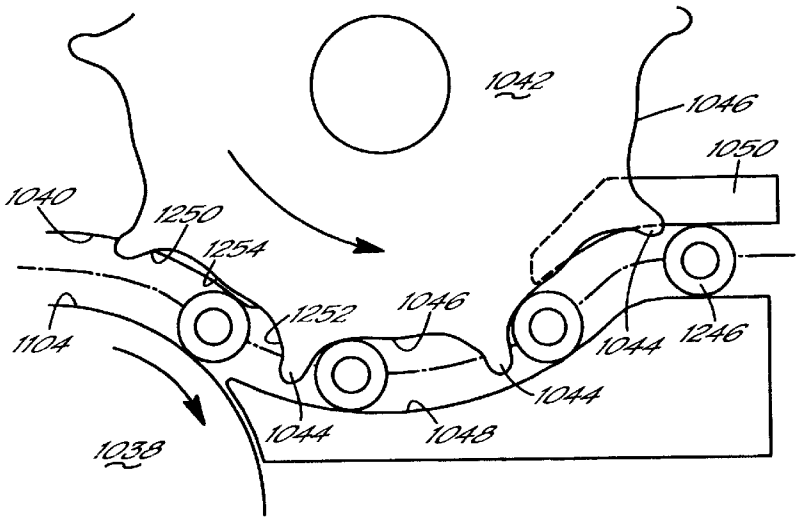
Figure 7C:
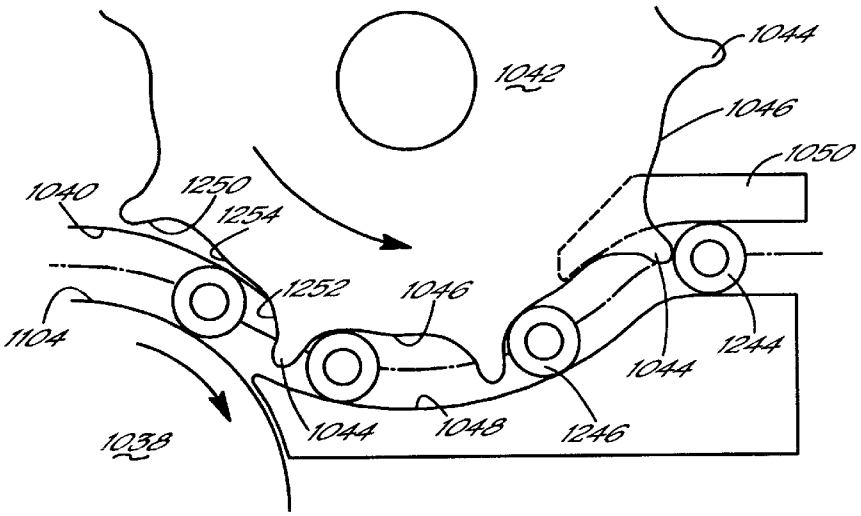

As illustrated, for example, by article 1242, the article is fully seated within a pocket of starwheel 1042 as the article engages arcuate guide 1050. Next, as shown in FIG. 7B, as the article is advanced by starwheel 1042, the linear velocity of the article along the direction of the conveyor decreases as the article is conveyed by the tip of the tooth 1044 against which the article rests. As shown in FIG. 7C, further rotation of starwheel 1042 results in a further decrease in velocity for article 1242, until the conveyor picks up the article and carries away from starwheel 1042, as shown in FIG. 7D.

Figure 8:
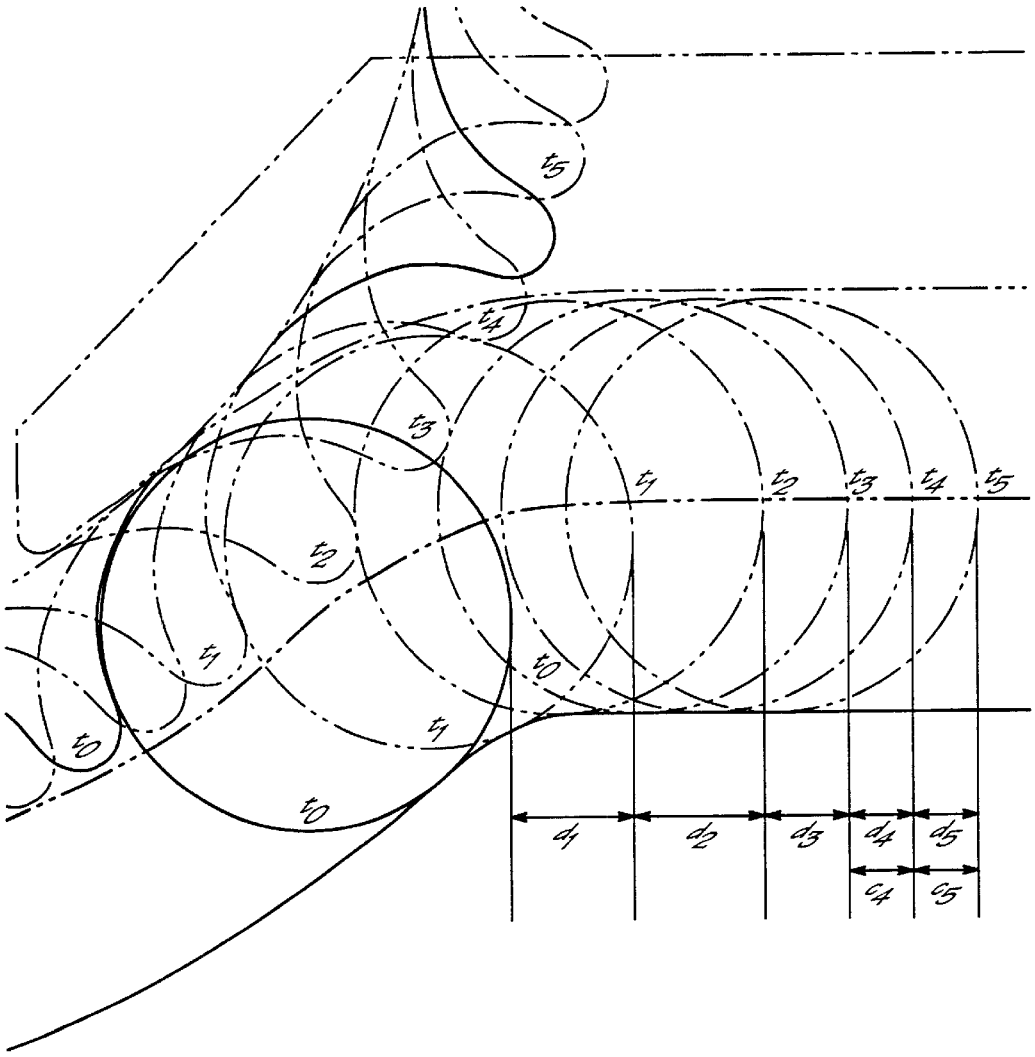
FIG. 8 is a functional top plan view of the article discharge portion of the labeling apparatus of FIG. 1, illustrating the position of an article at a plurality of points during the rotation of the discharge starwheel.

FIG. 8 illustrates in another way the linear velocity imparted to an article transported by starwheel 1042 at equal time intervals during the rotation of starwheel 1042. The position of the starwheel and the container 1242 is illustrated at six points of time $t_0$–$t_5$ with the linear movement of the article during each time interval therebetween denoted as $d_1$–$d_5$. The rate of advancement of the conveyor during the last two time intervals is illustrated at $c_4$ and $c_5$ (it being understood that the conveyor is advancing at the same rate during the earlier time intervals as well). It can be seen that from time $t_0$ to time $t_4$, the article is advanced at a linear rate that exceeds that of the conveyor. However, once the linear rate falls below that of the conveyor at time $t_4$, the article is advanced at the rate of the conveyor, and subsequently carried away from the discharge starwheel.

It should be appreciated that other starwheel profiles may be utilized in discharge starwheel 1042 consistent with the invention.

Furthermore, it will also be appreciated by one skilled in the art that the various enhancements to the herein described label application assemblies and carrier mechanisms may be utilized independently of one another in other applications. Moreover, various additional modifications may be made to the illustrated embodiments without departing from the spirit and scope of the invention. Therefore, the invention lies in the claims hereinafter appended.

What is claimed is:

1. A starwheel, comprising:

(a) a rotatable hub configured to rotate about an axis of rotation; and (b) an engagement surface defining a pocket configured to engage an article, wherein the engagement surface is resiliently coupled to the rotatable hub to move between first and second positions to vary a rotational position of the pocket relative to the hub, wherein the engagement surface comprises a disk including a plurality of teeth disposed about a periphery thereof, wherein the disk is rotatably coupled to the hub, wherein the pocket is defined between a pair of adjacent teeth, wherein the first position leads the second position in the direction of rotation of the hub, and wherein the disk is resiliently biased toward the first position.

2. The starwheel of claim 1, wherein the disk is resiliently coupled to the hub using at least one spring.

3. The starwheel of claim 1, further comprising a second disk including a plurality of teeth and rotatably coupled to the hub to rotate between first and second positions, the first and second disks coupled to one another to cooperatively rotate relative to the hub.

4. The starwheel of claim 3, wherein the hub further includes a plurality of teeth disposed about the periphery thereof, wherein the plurality of teeth on the hub are interposed between the first and second disks, and wherein each tooth on the hub is configured to lag a corresponding pair of teeth on the first and second disks in the direction of rotation of the hub when the first and second disks are disposed in the first positions thereof.

5. An apparatus, comprising:

(a) a label application station configured to apply a label to an article;

(b) an arcuate guide having infeed and discharge ends, the discharge end disposed proximate the label application station;

(c) a first starwheel rotatably coupled opposite the arcuate guide, the first starwheel configured to transport an article between the infeed and discharge ends of the arcuate guide; and (d) a second starwheel disposed proximate the infeed end of the arcuate guide to control the flow of articles to the first starwheel, the second starwheel including:

(i) a rotatable hub configured to rotate about an axis of rotation; and (ii) an engagement surface defining a pocket configured to engage an article, wherein the engagement surface is resiliently coupled to the rotatable hub to move between first and second positions to vary a rotational position of the pocket relative to the hub, wherein the engagement surface comprises a disk including a plurality of teeth disposed about a periphery thereof, wherein the disk is rotatably coupled to the hub, wherein the pocket is defined between a pair of adjacent teeth, wherein the first position leads the second position in the direction of rotation of the hub, and wherein the disk is resiliently biased toward the first position.

6. The apparatus of claim 5, wherein the first and second starwheels oppose one another proximate the infeed end of the arcuate guide, and wherein the engagement surface is resiliently biased toward the first position to minimize clearance between an article and each of the first and second starwheels when the article is transferred between the first and second starwheels.

7. A method of transferring an article, the method comprising:

(a) transferring an article to a first starwheel with a second starwheel, the second starwheel including a rotatable hub and an engagement surface upon which is defined a pocket for receiving the article, the engagement surface resiliently coupled to the hub to move between first and second positions and thereby vary a rotational position of the pocket relative to the hub; and (b) minimizing clearance between the article and each of the first and second starwheels while the article is being transferred by moving the engagement surface relative to the hub in response to compression of the article between the first and second starwheels, wherein the engagement surface comprises a disk including a plurality of teeth disposed about a periphery thereof, wherein the disk is rotatably coupled to the hub, wherein the pocket is defined between a pair of adjacent teeth, wherein the first position leads the second position in the direction of rotation of the hub, and wherein the disk is resiliently biased toward the first position.

8. The method of claim 7, wherein the second starwheel further includes a second disk including a plurality of teeth and rotatably coupled to the hub to rotate between first and second positions, the first and second disks coupled to one another to cooperatively rotate relative to the hub, wherein the hub further includes a plurality of teeth disposed about the periphery thereof, wherein the plurality of teeth on the hub are interposed between the first and second disks, and wherein each tooth on the hub is configured to lag a corresponding pair of teeth on the first and second disks in the direction of rotation of the hub when the first and second disks are disposed in the first positions thereof.

* * * * *